US011462159B2

(12) United States Patent
Onoyama et al.

(10) Patent No.: US 11,462,159 B2
(45) Date of Patent: Oct. 4, 2022

(54) DISPLAY DEVICE, DRIVING METHOD FOR DISPLAY DEVICE AND ELECTRONIC APPARATUS

(71) Applicant: Sony Group Corporation, Tokyo (JP)

(72) Inventors: Yusuke Onoyama, Kanagawa (JP); Junichi Yamashita, Tokyo (JP); Naobumi Toyomura, Kanagawa (JP)

(73) Assignee: Sony Group Corporation, Toyko (JP)

( * ) Notice: Subject to any disclaimer, the term of this patent is extended or adjusted under 35 U.S.C. 154(b) by 0 days.

(21) Appl. No.: 16/816,838

(22) Filed: Mar. 12, 2020

(65) Prior Publication Data

US 2020/0320931 A1 Oct. 8, 2020

Related U.S. Application Data

(63) Continuation of application No. 16/292,852, filed on Mar. 5, 2019, which is a continuation of application (Continued)

(30) Foreign Application Priority Data

Jul. 8, 2013 (JP) ..... 2013-142831

(51) Int. Cl.
*G09G 3/3233* (2016.01)

(52) U.S. Cl.
CPC ... *G09G 3/3233* (2013.01); *G09G 2300/0819* (2013.01); *G09G 2300/0852* (2013.01);

(Continued)

(58) Field of Classification Search
None
See application file for complete search history.

(56) References Cited

U.S. PATENT DOCUMENTS 5,729,249 A 3/1998 Yasutake
7,157,649 B2 1/2007 Hill (Continued)

FOREIGN PATENT DOCUMENTS

CN 101312012 A 11/2008
CN 101577083 A 11/2009

(Continued)

OTHER PUBLICATIONS

USPTO Final Rejection dated Jun. 8, 2020 for related U.S. Appl. No. 16/292,852.

(Continued)

*Primary Examiner* — William Boddie
*Assistant Examiner* — Bipin Gyawali
(74) *Attorney, Agent, or Firm* — Michael Best & Friedrich LLP

(57) ABSTRACT

A display device includes a pixel array unit formed by disposing pixel circuits having a P-channel type drive transistor that drives a light-emitting unit, a sampling transistor that applies a signal voltage, a light emission control transistor that controls emission/non-emission of the light-emitting unit, a storage capacitor that is connected between a gate electrode and a source electrode of the drive transistor and an auxiliary capacitor that is connected to the source electrode, and a drive unit that, during threshold correction, respectively applies a first voltage and a second voltage to the source electrode of the drive transistor and the gate electrode thereof, the difference between the first voltage and the second voltage being less than a threshold voltage of the drive transistor, and subsequently performs driving that applies a standard voltage used in threshold correction to the gate electrode when the source electrode is in a floating state.

18 Claims, 11 Drawing Sheets

Related U.S. Application Data

No. 14/289,259, filed on May 28, 2014, now Pat. No. 10,621,911.

(52) U.S. Cl.
CPC ..... *G09G 2300/0861* (2013.01); *G09G 2320/0238* (2013.01); *G09G 2320/045* (2013.01)

(56) References Cited

U.S. PATENT DOCUMENTS

| | | | | |
|---|---|---|---|---|
| 8,049,684 | B2 | 11/2011 | Kim | |
| 8,094,226 | B2 * | 1/2012 | Hattori | H04N 5/3658 348/308 |
| 8,269,755 | B2 | 9/2012 | Minami | |
| 2006/0170628 | A1 * | 8/2006 | Yamashita | G09G 3/3266 345/76 |
| 2007/0118781 | A1 | 5/2007 | Kim | |
| 2007/0152919 | A1 * | 7/2007 | Tseng | G09G 3/3233 345/76 |
| 2008/0237468 | A1 | 10/2008 | Honda et al. | |
| 2008/0291182 | A1 * | 11/2008 | Yamashita | G09G 3/3233 345/204 |
| 2009/0135111 | A1 | 5/2009 | Yamamoto et al. | |
| 2009/0179831 | A1 | 7/2009 | Yamashita et al. | |
| 2009/0219231 | A1 | 9/2009 | Yamamoto et al. | |
| 2009/0322722 | A1 | 12/2009 | Toyomura et al. | |
| 2010/0013821 | A1 | 1/2010 | Toyomura et al. | |
| 2010/0033462 | A1 | 2/2010 | Hasegawa et al. | |
| 2010/0084955 | A1 | 4/2010 | Kim | |
| 2010/0149079 | A1 | 6/2010 | Yamashita et al. | |
| 2011/0084945 | A1 * | 4/2011 | Wang | G09G 3/3688 345/211 |
| 2011/0109664 | A1 | 5/2011 | Toyomura et al. | |
| 2011/0109817 | A1 | 5/2011 | Toyomura et al. | |
| 2011/0273419 | A1 * | 11/2011 | Park | H01L 27/3276 345/211 |
| 2011/0309362 | A1 | 12/2011 | Yoon et al. | |
| 2012/0162188 | A1 | 6/2012 | Yamashita et al. | |
| 2013/0057457 | A1 | 3/2013 | Omoto | |
| 2014/0132175 | A1 | 5/2014 | Hokazono et al. | |
| 2014/0231805 | A1 | 8/2014 | Tatara | |
| 2014/0333604 | A1 | 11/2014 | Omoto et al. | |
| 2015/0009201 | A1 | 1/2015 | Onoyama et al. | |
| 2015/0029079 | A1 | 1/2015 | Miyazawa et al. | |
| 2015/0042635 | A1 | 2/2015 | Kimura et al. | |
| 2015/0154911 | A1 | 6/2015 | Toyomura et al. | |
| 2019/0180692 | A1 * | 6/2019 | Fujii | H01L 27/3265 |
| 2020/0143741 | A1 * | 5/2020 | Tsuboi | G09G 3/3233 |

FOREIGN PATENT DOCUMENTS

| | | | |
|---|---|---|---|
| CN | 101630483 | A | 1/2010 |
| CN | 102144251 | A | 8/2011 |
| CN | 102549646 | A | 7/2012 |
| CN | 102568379 | A | 7/2012 |
| CN | 102903326 | A | 1/2013 |
| JP | 2008-287141 | | 11/2008 |
| JP | 2010-128356 | A | 10/2010 |
| JP | 2013057727 | A | 3/2013 |
| WO | WO-2012/032560 | A | 3/2012 |

OTHER PUBLICATIONS

USPTO Notice of Allowance dated Dec. 12, 2019 for related U.S. Appl. No. 14/289,259.

Chinese Office Action dated Jun. 16, 2021 for corresponding Chinese Application No. 2019101820886.

Chinese Office Action dated Dec. 17, 2021 for corresponding Chinese Application No. 201901814527.

* cited by examiner

DISPLAY DEVICE, DRIVING METHOD FOR DISPLAY DEVICE AND ELECTRONIC APPARATUS

CROSS REFERENCE TO RELATED APPLICATIONS

This application is a Continuation of application Ser. No. 16/292,852, filed Mar. 5, 2019, which is a Continuation of application Ser. No. 14/289,259, filed May 28, 2014, and claims the benefit of Japanese Priority Patent Application JP 2013-142831 filed Jul. 8, 2013, the entire contents of which are incorporated herein by reference.

BACKGROUND

The present disclosure relates to a display device, a driving method for a display device and an electronic apparatus, and in particular, relates to a flat type (flat panel type) display device that is formed by pixels that include a light-emitting unit being disposed in rows and columns (matrix form), a driving method for the display device and an electronic apparatus that includes the display device.

A display device that uses so-called current drive type electro-optical elements in which the brightness of light emission changes depending on a current value that flows to the light-emitting units (light-emitting elements) as a light-emitting unit of pixels, is a type of flat type display device. For example, organic electroluminescence (EL) elements that use the electroluminescence of an organic material and make use of a phenomenon in which light is emitted when an electrical field is applied to an organic thin film, are known as current drive type electro-optical elements.

Amongst flat type display devices that are typified by organic EL display devices, there are devices that, in addition to using P-channel type transistors as drive transistors that drive the light-emitting units, have a function of correcting variations in the threshold voltage of the drive transistors and the movement amount thereof. Pixel circuits in these display devices have a configuration that includes a sampling transistor, a switching transistor, a storage capacitor and an auxiliary capacitor in addition to a drive transistor (for example, refer to Japanese Unexamined Patent Application Publication No. 2008-287141).

SUMMARY

In the display device as in the abovementioned example of the related art, since a minute through current flows to the light-emitting units during a correction preparation period of the threshold voltage (a threshold correction preparation period), the light-emitting units emit light at a constant brightness for each frame without being dependent on the gradation of a signal voltage despite the fact that it is a non-light-emitting period. As a result of this, a problem in that the reduction in the contrast of a display panel is caused.

It is desirable to provide a display device in which it is possible to solve the problem of the reduction in contrast by suppressing the through current that flows to the light-emitting units in the non-light emission periods, a driving method for the display device and an electronic apparatus that includes the display device.

According to an embodiment of the present disclosure, there is provided a display device that includes a pixel array unit that is formed by disposing pixel circuits that include a P-channel type drive transistor that drives a light-emitting unit, a sampling transistor that applies a signal voltage, a light emission control transistor that controls light emission and non-light emission of the light-emitting unit, a storage capacitor that is connected between a gate electrode and a source electrode of the drive transistor and an auxiliary capacitor that is connected to the source electrode of the drive transistor, and a drive unit that, during threshold correction, respectively applies a first voltage and a second voltage to the source electrode of the drive transistor and the gate electrode thereof, the difference between the first voltage and the second voltage being less than a threshold voltage of the drive transistor, and subsequently performs driving that applies a standard voltage that is used in threshold correction to the gate electrode in a state in which the source electrode of the drive transistor has been set to a floating state.

According to another embodiment of the present disclosure, there is provided a driving method for a display device in which, when a display device that is formed by disposing pixel circuits, which include a P-channel type drive transistor that drives a light-emitting unit, a sampling transistor that applies a signal voltage, a light emission control transistor that controls light emission and non-light emission of the light-emitting unit, a storage capacitor that is connected between a gate electrode and a source electrode of the drive transistor and an auxiliary capacitor that is connected to the source electrode of the drive transistor, is driven, during threshold correction, a first voltage and a second voltage are applied to the source electrode of the drive transistor and the gate electrode thereof, the difference between the first voltage and the second voltage being less than a threshold voltage of the drive transistor, and subsequently a standard voltage that is used in threshold correction is applied to the gate electrode of the drive transistor.

According to still another embodiment of the present disclosure, there is provided an electronic apparatus includes a display device that includes a pixel array unit that is formed by disposing pixel circuits that include a P-channel type drive transistor that drives a light-emitting unit, a sampling transistor that applies a signal voltage, a light emission control transistor that controls light emission and non-light emission of the light-emitting unit, a storage capacitor that is connected between a gate electrode and a source electrode of the drive transistor and an auxiliary capacitor that is connected to the source electrode of the drive transistor, and a drive unit that, during threshold correction, respectively applies a first voltage and a second voltage to the source electrode of the drive transistor and the gate electrode thereof, the difference between the first voltage and the second voltage being less than a threshold voltage of the drive transistor, and subsequently performs driving that applies a standard voltage that is used in threshold correction to the gate electrode in a state in which the source electrode of the drive transistor has been set to a floating state.

In the display device with the abovementioned configuration, the driving method thereof and electronic apparatus, a voltage between the gate and the source of the drive transistor is smaller than the threshold voltage of the drive transistor as a result of the first voltage and the second voltage being respectively applied to the source electrode of the drive transistor and the gate electrode thereof. As a result of this, since the drive transistor attains a non-conductive state, the light-emitting unit attains an extinguished state without the supply of a current to the light-emitting unit being performed. Thereafter, a standard voltage for threshold correction is applied to the gate electrode of the drive transistor, the source electrode of which is in a floating state.

At this time, since the source potential of the drive transistor falls with the gate potential thereof due to capacitance coupling of the storage capacitor and the auxiliary capacitor, the voltage between the gate and the source of the drive transistor is amplified to greater than or equal to the threshold voltage. As a result of this, due to the capacitance coupling of the storage capacitor and the auxiliary capacitor, the voltage between the gate and the source of the drive transistor is set to greater than or equal to the threshold voltage at the same time as the application of the standard voltage for initialization of the gate electrode of the drive transistor. Therefore, since it is not necessary to provide a threshold correction preparation period in which a through current flows, it is possible to suppress a through current to the light-emitting unit in a non-light emission period.

According to the present disclosure, it is possible to solve the problem of a reduction in contrast since it is possible to suppress a through current to the light-emitting unit in the non-light emission period.

Additionally, the effect of the present disclosure is not necessarily limited to the abovementioned effect and may be any of the effects that are disclosed in the present specification. In addition, the effects that are disclosed in the present specification are merely examples, the present disclosure is not limited thereto and additional effects are possible.

DETAILED DESCRIPTION OF EMBODIMENTS

Figure 1:
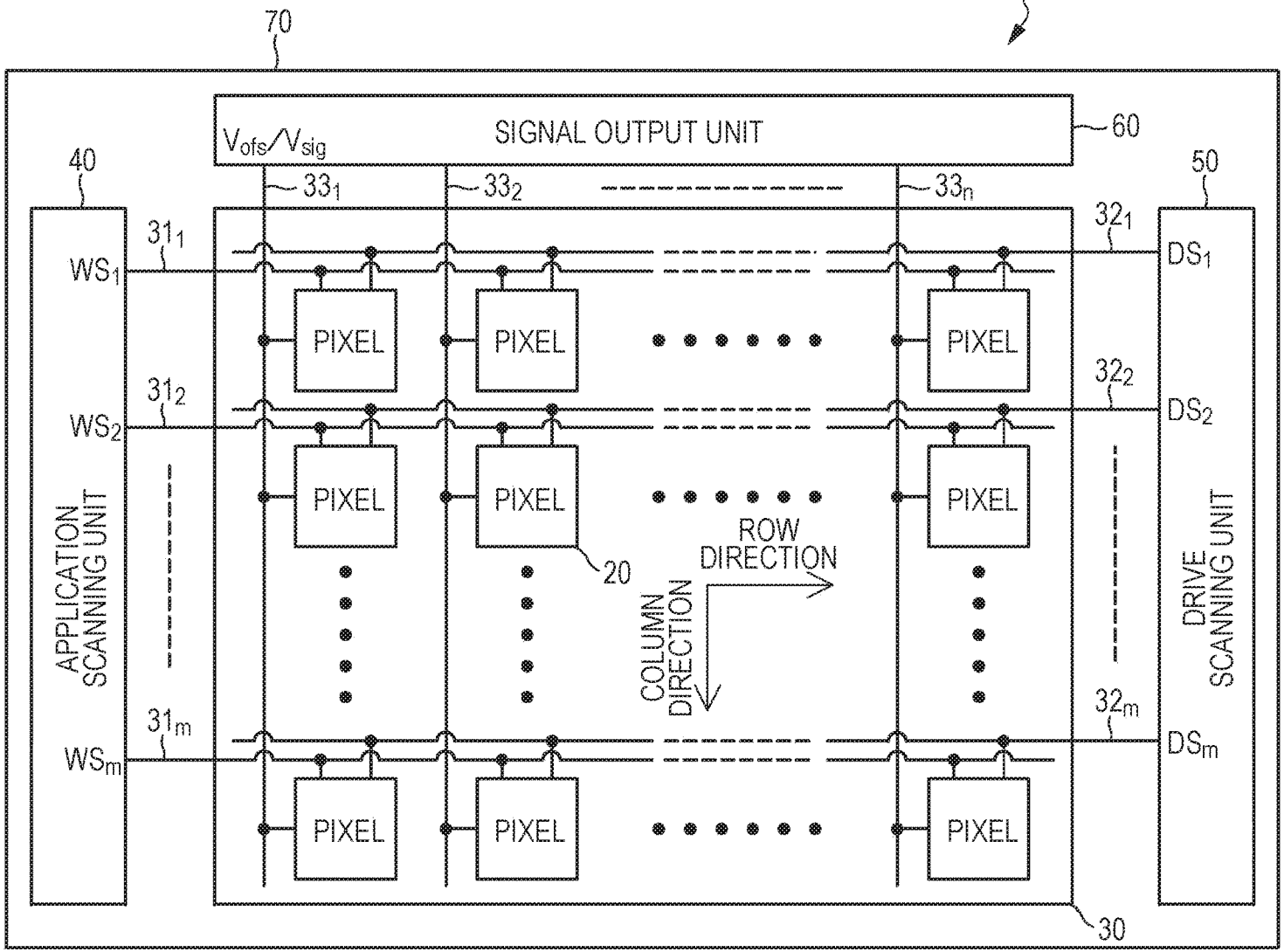
FIG. 1 is a system configuration diagram that illustrates an outline of a basic configuration of an active matrix type display device that forms the premise for the present disclosure.

Hereinafter, embodiments for implementing the technology of the present disclosure (hereinafter, referred to as "embodiments") will be described in detail using the drawings. The present disclosure is not limited to the embodiments, and the various numerical values and the like in the embodiments are examples. In the following description, like components and components that have the same function will be given the same symbols, and overlapping descriptions will be omitted. Additionally, the description will be given in the following order.

1. General Description relating to Display Device, Driving Method for Display Device and Electronic Apparatus of Present Disclosure
2. Active Matrix Type Display Device that forms Premise for Present Disclosure
   - 2-1 System Configuration
   - 2-2 Pixel Circuit
   - 2-3 Basic Circuit Operation
   - 2-4 Defects In Threshold Correction Preparation Period
3. Description of Embodiments
4. Modification Examples
5. Electronic Apparatus General Description Relating to Display Device, Driving Method for Display Device and Electronic Apparatus of Present Disclosure In the display device, driving method for a display device and electronic apparatus of the present disclosure, a configuration in which a P-channel type transistor is used as a drive transistor that drives light-emitting units, is adopted. The reason using a P-channel type transistor instead of an N-channel type transistor as the drive transistor will be described below.

Assuming a case in which a transistor is formed on a semiconductor such as silicon instead of on an insulating body such as a glass substrate, the transistor forms the four terminals of source, gate, drain and back gate (base) instead of the three terminals of source, gate and drain. Further, in a case in which an n-channel type transistor is used as the drive transistor, the back gate (the substrate) potential is 0 V, and this brings about an adverse effect on the operations and the like of correcting variations in the threshold voltage of the drive transistor in each pixel.

In addition, in comparison with n-channel type transistors that have an LDD (Lightly Doped Drain) region, characteristic variation of the transistor is less in P-channel type transistors that do not have an LDD region, and P-channel type transistors are advantageous since miniaturization of the pixels and improved definition of the display device can be achieved. For the abovementioned reasons, it is preferable to use a P-channel type transistor instead of an N-channel type transistor as the drive transistor in a case in which formation on a semiconductor such as silicon is assumed.

The display device of the present disclosure is a flat type (flat panel type) display device that is formed by pixel circuits that include a sampling transistor, a light emission control transistor, a storage capacitor and an auxiliary capacitor in addition to the P-channel type drive transistor. It is possible to include an organic EL display device, a liquid crystal display device, a plasma display device and the like as examples of a flat type display device. Among these display devices, organic EL display devices use an organic electroluminescence element (hereinafter, referred to as an "organic EL element") that uses the electroluminescence of an organic material, and makes use of a phenomenon in which light is emitted when an electrical field is applied to an organic thin film, as a light emitting element (an electro-optical element) of a pixel.

Organic EL display devices that use organic EL elements as the light-emitting unit of a pixel have the following characteristics. That is, since it is possible for organic EL elements to be driven with an application voltage of less than or equal to 10 V, organic EL display devices are low power consumption. Since organic EL elements are self-luminous type elements, the visibility of the pixels in organic EL display devices is high in comparison with liquid crystal display devices, which are also flat type display devices, and additionally, since an illumination member such as a backlight is not necessary, weight saving and thinning are easy. Furthermore, since the response speed of organic EL elements is extremely fast to the extent of approximately a few microseconds, organic EL display devices do not generate a residual image during video display.

In addition to being self-luminous type elements, the organic EL elements that configure the light-emitting units are current drive type electro-optical elements in which the brightness of light emission changes depending on a current value that flows to the device. In addition to organic EL elements, it is possible to include inorganic EL elements, LED elements, semiconductor laser elements and the like as current drive type electro-optical elements.

Flat type display devices such as organic EL display devices can be used as a display unit (display device) in various electronic apparatuses that are provided with a display unit. It is possible to include head-mounted displays, digital cameras, video cameras, game consoles, notebook personal computers, portable information devices such as e-readers, mobile communication units such as Personal Digital Assistants (PDAs) and cellular phones as examples of the various electronic apparatuses.

In the display device, driving method for a display device and electronic apparatus of the present disclosure, it is possible to adopt a configuration in which the first voltage is a power supply voltage of pixels. At this time, it is possible to adopt a configuration in which the light emission control transistor is connected between a node of the power supply voltage and the source electrode of the drive transistor. Further, it is possible to apply the power supply voltage to the source electrode of the drive transistor by setting the light emission control transistor to a conductive state, and in addition, it is possible to set the source electrode of the drive transistor to a floating state by setting the light emission control transistor to a non-conductive state.

In the display device, driving method for a display device and electronic apparatus of the present disclosure that include the abovementioned preferable configurations, it is possible to adopt a configuration in which the second voltage is the same as the power supply voltage of the pixels. Alternatively, it is possible to adopt a configuration in which the second voltage is a voltage that is different from the power supply voltage of pixels.

In addition, in the display device, driving method for a display device and electronic apparatus of the present disclosure that include the abovementioned preferable configurations, it is possible to adopt a configuration in which the sampling transistor is connected between a signal line and the gate electrode of the drive transistor. At this time, it is possible to adopt a configuration in which the second voltage is applied through sampling of the sampling transistor. Alternatively, it is possible to adopt a configuration in which the standard voltage is applied through sampling of the sampling transistor.

In addition, in the display device, driving method for a display device and electronic apparatus of the present disclosure that include the abovementioned preferable configurations, it is possible to adopt a configuration in which the source potential of the drive transistor is raised through capacitance coupling of the storage capacitor and the auxiliary capacitor when the standard voltage is applied. Alternatively, it is possible to adopt a configuration in which the voltage between the gate and the source of the drive transistor is amplified through capacitance coupling of the storage capacitor and the auxiliary capacitor when the standard voltage is applied.

In addition, in the display device, driving method for a display device and electronic apparatus of the present disclosure that include the abovementioned preferable configurations, the capacitance value of the storage capacitor can be set arbitrarily, but it is preferable that the capacitance value of the storage capacitor be set to greater than or equal to the capacitance value of the auxiliary capacitor.

In addition, in the display device, driving method for a display device and electronic apparatus of the present disclosure that include the abovementioned preferable configurations, it is possible to adopt a configuration in which, as an operation point of the pixel circuit, the maximum possible voltage is (power supply voltage−signal voltage). At this time, it is possible to adopt a configuration in which a high-permittivity material is used in the storage capacitor and the auxiliary capacitor.

In addition, in the display device, driving method for a display device and electronic apparatus of the present disclosure that include the abovementioned preferable configurations, it is possible to adopt a configuration in which the second voltage is applied to the signal line, and is sampled by the sampling transistor. At this time, it is possible to adopt a configuration in which the intermediate voltage between the second voltage and the signal voltage is applied prior to the application of the second voltage to the signal line.

In addition, in the display device, driving method for a display device and electronic apparatus of the present disclosure that include the abovementioned preferable configurations, it is possible to adopt a configuration in which the sampling transistor and the light emission control transistor are formed from the same P-channel type transistor as the drive transistor.

Active Matrix Type Display Device that forms Premise for Present Disclosure System Configuration FIG. 1 is a system configuration diagram that illustrates an outline of a basic configuration of an active matrix type display device that forms the premise for the present disclosure. The active matrix type display device that forms the premise for the present disclosure is also the active matrix type display device as in the example of the related art that is disclosed in Japanese Unexamined Patent Application Publication No. 2008-287141.

The active matrix type display device is a display device that controls a current that flows to an electro-optical device using an active element, for example, an insulated-gate field effect transistor, which is provided inside the same pixel circuit as the electro-optical device. Typically, it is possible to include a Thin Film Transistor (TFT) as an example of an insulated-gate field effect transistor.

In this instance, a case of an active matrix type organic EL display device display that uses an organic EL element, one example of a current drive type electro-optical element in which light emission brightness changes depending on a current value that flows in a device, as a light-emitting unit (light emitting element) of a pixel circuit will be described as an example. Hereinafter, there are cases in which "pixel circuits" are simply referred to as "pixels".

As shown in FIG. 1, an organic EL display device 100 that forms the premise for the present disclosure has a configuration that includes a pixel array unit 30 that is formed by disposing a plurality of pixels 20, which include an organic EL element, two-dimensionally in matrix form, and a drive unit that is disposed in the periphery of the pixel array unit 30. The drive unit, for example, is formed by a application scanning unit 40 that is mounted on the same display panel 70 as the pixel array unit 30, a drive scanning unit 50, a signal output unit 60 and the like, and drives each pixel 20 of the pixel array unit 30.

Additionally, it is possible to adopt a configuration in which a number of or all of the application scanning unit 40, the drive scanning unit 50 and the signal output unit 60 are provided outside the display panel 70.

In this instance, in a case in which the organic EL display device 100 is a display device that is capable of color display, a single pixel (unit pixel/pixel), which is the unit that forms a color image, is configured from a plurality of subpixels. In this case, each subpixel corresponds to the pixels 20 of FIG. 1. More specifically, in a display device that is capable of color display, a single pixel is for example, configured from three subpixels of a subpixel that emits red (R) light, a subpixel that emits green (G) light and a subpixel that emits blue (B) light.

However, the present disclosure is not limited to the subpixel combination of the three primary colors of RGB as one pixel, and it is possible to configure a single pixel by further adding a subpixel of a color or subpixels of a plurality of colors to the subpixels of the three primary colors. More specifically, for example, it is possible to configure a single pixel by adding a subpixel that emits white (W) light for improving brightness, and it is also possible to configure a single pixel by adding at least one subpixel that emits complementary color light for expanding the color reproduction range.

Scanning lines 31 ($\mathbf{31}_1$ to $\mathbf{31}_m$) and drive lines 32 ($\mathbf{32}_1$ to $\mathbf{32}_m$) are wired in the pixel array unit 30 along a row direction (an arrangement direction of the pixels of a pixel row/a horizontal direction) for each pixel row with respect to an arrangement of m rows and n columns of pixels 20. Furthermore, signal lines 33 ($\mathbf{33}_1$ to $\mathbf{33}_n$) are wired along a column direction (an arrangement direction of the pixels of a pixel column/a vertical direction) for each pixel column with respect to an arrangement of m rows and n columns of pixels 20.

The scanning lines $\mathbf{31}_1$ to $\mathbf{31}_m$ are respectively connected to output ends of corresponding rows of the application scanning unit 40. The drive lines $\mathbf{32}_1$ to $\mathbf{32}_m$ are respectively connected to output ends of corresponding rows of the drive scanning unit 50. The signal lines $\mathbf{33}_1$ to $\mathbf{33}_n$ are respectively connected to output ends of corresponding columns of the signal output unit 60.

The application scanning unit 40 is configured by a shift transistor circuit and the like. The application scanning unit 40 sequentially supplies application scanning signals WS ($WS_1$ to $WS_m$) to the scanning lines 31 ($\mathbf{31}_1$ to $\mathbf{31}_m$) during the application of a signal voltage of an image signal to each pixel 20 of the pixel array unit 30. As a result of this, so-called line sequential scanning that scans each pixel 20 of the pixel array unit 30 in order in units of rows is performed.

The drive scanning unit 50 is configured by a shift transistor circuit and the like in the same manner as the application scanning unit 40. The drive scanning unit 50 performs control of the light emission and non-light emission of the pixels 20 by supplying light emission control signals DS ($DS_1$ to $DS_m$) to the drive lines 32 ($\mathbf{32}_1$ to $\mathbf{32}_m$) in synchronization with the line sequential scanning of the application scanning unit 40.

The signal output unit 60 selectively outputs a signal voltage (hereinafter, there are cases in which this signal voltage is simply referred to as a "signal voltage") $V_{sig}$ of an image signal that depends on brightness information that is supplied from a signal supply source (not shown in the drawings) and a standard voltage $V_{ofs}$. In this instance, the standard voltage $V_{ofs}$ is a voltage that forms a standard for the signal voltage $V_{sig}$ of an image signal (for example, a voltage that corresponds to a black level of an image signal), and is used in threshold correction (to be described later).

The signal voltage $V_{sig}$ and the standard voltage $V_{ofs}$ that are selectively output from the signal output unit 60 are applied to each pixel 20 of the pixel array unit 30 through the signal lines 33 ($\mathbf{33}_1$ to $\mathbf{33}_n$) in units of pixel rows that are selected by the scanning of the application scanning unit 40. That is, the signal output unit 60 adopts a line sequential application driving form that applies the signal voltage $V_{sig}$ in units of rows (lines).

[Pixel Circuit]

Figure 2:
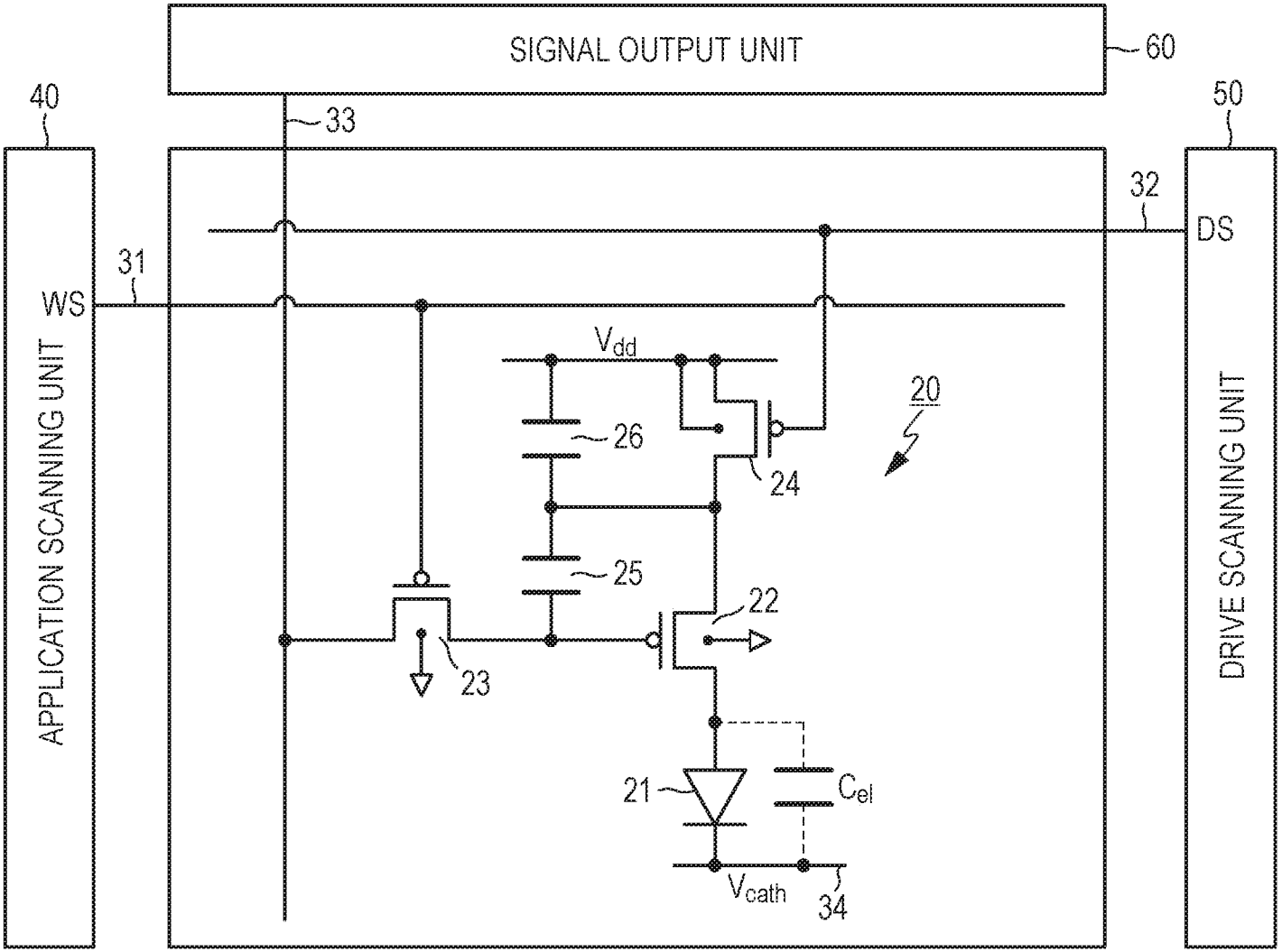
FIG. 2 is a circuit diagram that illustrates an example of a circuit of a pixel (a pixel circuit) in the active matrix type display device that forms the premise for the present disclosure.

FIG. 2 is a circuit diagram that illustrates an example of a circuit of a pixel (a pixel circuit) in the active matrix type display device that forms the premise for the present disclosure, that is, the active matrix type display device as in the example of the related art. The light-emitting unit of the pixel 20 is formed from an organic EL element 21. The organic EL element 21 is an example of a current drive type electro-optical element in which light emission brightness changes depending on a current value that flows in a device.

As shown in FIG. 2, the pixel 20 is configured by the organic EL element 21, and a drive circuit that drives the organic EL element 21 by causing a current to flow to the organic EL element 21. In the organic EL element 21, a cathode electrode is connected to a common power supply line 34 that is commonly wired to all of the pixels 20.

The drive circuit that drives the organic EL element 21 has a configuration that includes a drive transistor 22, a sampling transistor 23, a light emission control transistor 24, a storage capacitor 25 and an auxiliary capacitor 26. Additionally, assuming a case of formation on a semiconductor such as silicon and not on an insulating body such as a glass substrate, a configuration in which a P-channel type transistor is used as the drive transistor 22, is adopted.

In addition, in the present example, a configuration in which a P-channel type transistor is also used for the sampling transistor 23 and the light emission control transistor 24 in the same manner as the drive transistor 22, is adopted. Therefore, the drive transistor 22, the sampling transistor 23 and the light emission control transistor 24 form the four terminals of source, gate, drain and back gate and not the three terminals of source, gate and drain. A power supply voltage $V_{dd}$ is applied to the back gate.

However, since the sampling transistor 23 and the light emission control transistor 24 are switching transistors that function as switching elements, the sampling transistor 23 and the light emission control transistor 24 are not limited to P-channel type transistors. Therefore, the sampling transistor 23 and the light emission control transistor 24 may be an N-channel type transistor or have a configuration in which a P-channel type and an N-channel type are mixed.

In a pixel 20 with the abovementioned configuration, the sampling transistor 23 applies a voltage the storage capacitor 25 by sampling the signal voltage $V_{sig}$ that is supplied from the signal output unit 60 through the signal lines 33. The light emission control transistor 24 is connected between a node of the power supply voltage $V_{dd}$ and the source electrode of the drive transistor 22, and controls light emission and non-light emission of the organic EL element 21 on the basis of the driving by the light emission control signals DS.

The storage capacitor 25 is connected between the gate electrode and the source electrode of the drive transistor 22. The storage capacitor 25 stores a signal voltage $V_{sig}$ that is applied thereto due to the sampling of the sampling transistor 23. The drive transistor 22 drives the organic EL element 21 by causing a drive current that depends on the storage voltage of the storage capacitor 25 to flow to the organic EL element 21.

The auxiliary capacitor 26 is connected between the source electrode of the drive transistor 22 and a node with a fixed potential, for example, a node of the power supply voltage $V_{dd}$ The auxiliary capacitor 26 controls the source potential of the drive transistor 22 from changing when the signal voltage $V_{sig}$ is applied, and performs an operation of setting a voltage $V_{gs}$ between the gate and the source of the drive transistor 22 to a threshold voltage $V_{th}$ of the drive transistor 22.

Basic Circuit Operation

Next, a basic circuit operation of the active matrix type organic EL display device 100 that forms the premise for the present disclosure and has the abovementioned configuration, will be described using the timing waveform diagram of FIG. 3.

Figure 3:
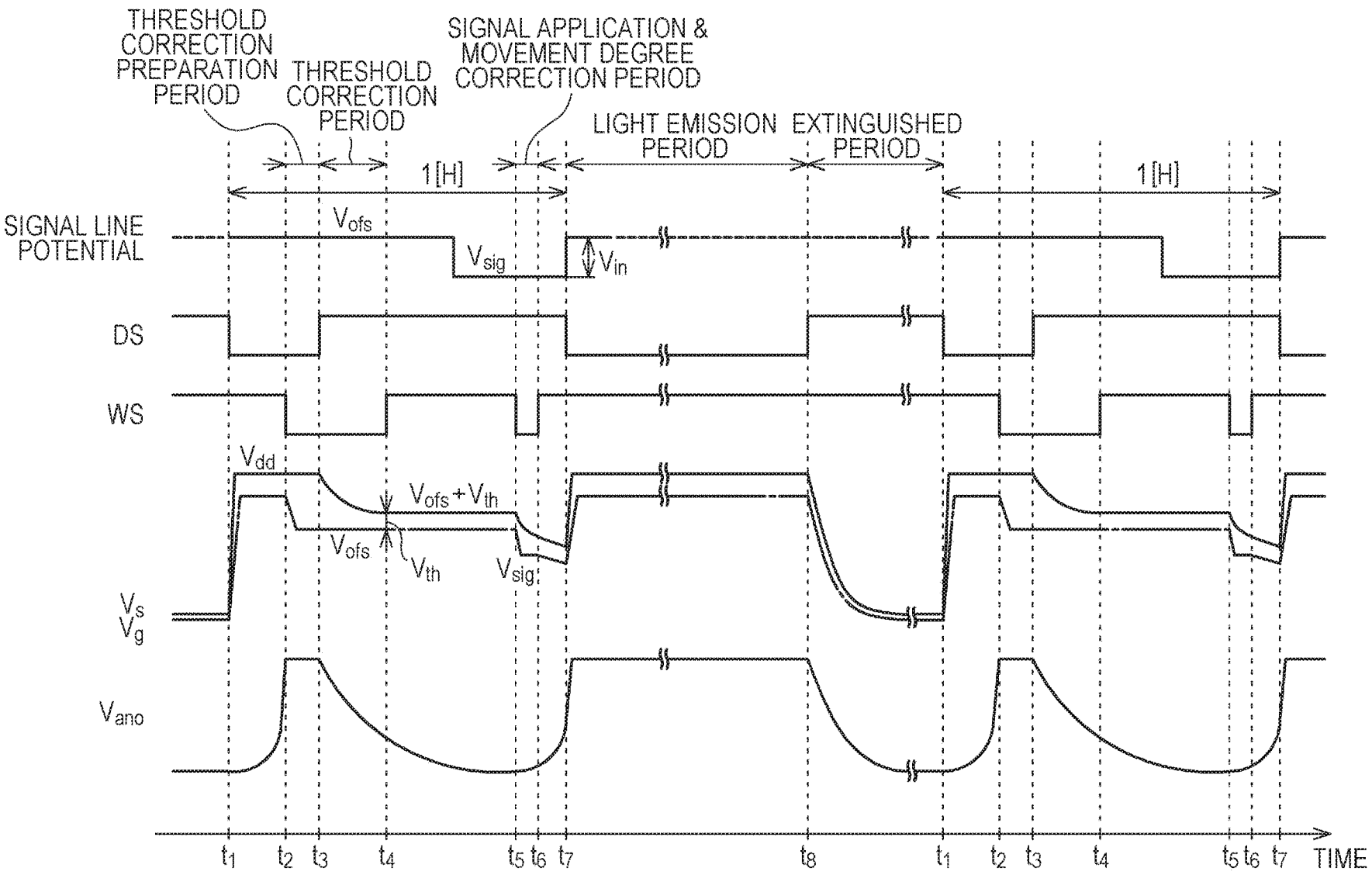
FIG. 3 is a timing waveform diagram for describing the circuit operation of the active matrix type display device that forms the premise for the present disclosure.

Respective Patterns of changes in the potentials $V_{ofs}$ and $V_{sig}$ of the signal lines 33, the light emission control signal DS, the application scanning signals WS, a source potential $V_s$ and a gate potential $V_g$ of the drive transistor 22, and an anode potential $V_{ano}$ of the organic EL element 21 are shown in the timing waveform diagram of FIG. 3. In the timing waveform diagram of FIG. 3, the waveform of the gate potential $V_g$ is shown with a dashed-dotted line.

Additionally, since the sampling transistor 23 and the light emission control transistor 24 are P-channel type transistors, low potential states of the application scanning signal WS and the light emission control signal DS are active states, and high potential states thereof are non-active states. Further, the sampling transistor 23 and the light emission control transistor 24 are in conductive states in the active states of the application scanning signal WS and the light emission control signal DS, and are in a non-conductive state in a non-active state thereof.

At a time $t_8$, the light emission control signal DS attains a non-active state, and an electric charge that is stored in the storage capacitor 25 is discharged through the drive transistor 22 due to the light emission control transistor 24 attaining a non-conductive state. Further, when the voltage $V_{gs}$ between the gate and the source of the drive transistor 22 becomes less than or equal to the threshold voltage $V_{th}$ of the drive transistor 22, the drive transistor 22 is cut off.

When the drive transistor 22 is cut off, since a pathway of current supply to the organic EL element 21 is blocked, the anode potential $V_{ano}$ of the organic EL element 21 gradually decreases. When the anode potential $V_{ano}$ of the organic EL element 21 eventually becomes less than or equal to a threshold voltage $V_{the1}$ of the organic EL element 21, the organic EL element 21 is attains a completely extinguished state. Thereafter, at a time $t_1$, the light emission control signal DS attains an active state, and the operation enters a subsequent 1H period (H is one horizontal period) due to the light emission control transistor 24 attaining a conductive state. As a result of this, a period of $t_8$ to $t_1$ is an extinguished period.

The power supply voltage $V_{dd}$ is applied to the source electrode of the drive transistor 22 due to the light emission control transistor 24 attaining a conductive state. Further, the gate potential $V_g$ rises in tandem with a rise in the source potential $V_s$ of the drive transistor 22. At a subsequent time $t_2$, the sampling transistor 23 attains a conductive state due to the application scanning signal WS attaining an active state, and samples the potential of the signal line 33. At this time, the operation is in a state in which the standard voltage $V_{ofs}$ is supplied to the signal line 33. Therefore, by sampling with the sampling transistor 23, the standard voltage $V_{ofs}$ is applied to the gate electrode of the drive transistor 22. As a result of this, a voltage of $(V_{dd}-V_{ofs})$ is stored in the storage capacitor 25.

In this case, in order to perform a threshold correction operation (to be described later), it is necessary to set the voltage $V_{gs}$ between the gate and the source of the drive transistor 22 to a voltage that exceeds the threshold voltage $V_{th}$ of the corresponding drive transistor 22. Therefore, each voltage value is set to a relationship in which $|V_{gs}|=|V_{dd}-V_{ofs}|>|V_{th}|$.

In this manner, an initialization operation that sets the gate potential $V_g$ of the drive transistor 22 to the standard voltage $V_{ofs}$ is an operation of preparation (threshold correction preparation) before performing the subsequent threshold correction operation. Therefore, the standard voltage $V_{ofs}$ is an initialization voltage of the gate potential $V_g$ of the drive transistor 22.

Next, at a time $t_3$, the light emission control signal DS attains a non-active state, and when the light emission control transistor 24 attains a non-conductive state, the source potential $V_s$ of the drive transistor 22 is set to a floating state. Further, the threshold correction operation is initiated in a state in which the gate potential $V_g$ of the drive transistor 22 is preserved in the standard voltage $V_{ofs}$. That is, the source potential $V_s$ of the drive transistor 22 starts to fall (decrease) toward a potential $(V_{ofs}-V_{th})$ at which the threshold voltage $V_{th}$ has been subtracted from the gate potential $V_g$ of the drive transistor 22.

In this manner, the initialization voltage $V_{ofs}$ of the gate potential $V_g$ of the drive transistor 22 is set as a standard, and an operation that changes the source potential $V_s$ of the drive transistor 22 toward a potential $(V_{ofs}-V_{th})$ at which the threshold voltage $V_{th}$ has been subtracted from the initialization voltage $V_{ofs}$ is the threshold correction operation. As the threshold correction operation proceeds, the voltage $V_{gs}$ between the gate and the source of the drive transistor 22 eventually converges with the threshold voltage $V_{th}$ of the drive transistor 22. A voltage that corresponds to the threshold voltage $V_{th}$ is retained in the storage capacitor 25. At this time, the source potential $V_s$ of the drive transistor 22 becomes $V_s=V_{ofs}-V_{th}$.

Further, at a time $t_4$, the application scanning signal WS attains a non-active state, and when the sampling transistor 23 attains a non-conductive state, a threshold correction period ends. Thereafter, the signal voltage $V_{sig}$ of an image signal is output to the signal line 33 from the signal output unit 60, and the potential of the signal line 33 is switched from the standard voltage $V_{ofs}$ to the signal voltage $V_{sig}$.

Next, at a time $t_5$, the sampling transistor 23 attains a conductive state due to the application scanning signal WS attaining an active state, and application to the pixel 20 is performed by sampling the signal voltage $V_{sig}$. The gate potential $V_g$ of the drive transistor 22 becomes the signal voltage $V_{sig}$ as a result of the application operation of the signal voltage $V_{sig}$ by the sampling transistor 23.

At the time of the application of the signal voltage $V_{sig}$ of the image signal, the auxiliary capacitor 26 that is connected between the source electrode of the drive transistor 22 and a node of the power supply voltage $V_{dd}$ performs an operation of suppressing changes in the source potential $V_s$ of the drive transistor 22. Further, at the time of the driving of the drive transistor 22 by the signal voltage $V_{sig}$ of the image signal, the threshold voltage $V_{th}$ of the corresponding drive transistor 22 is cancelled out by a voltage that corresponds to the threshold voltage $V_{th}$ that is stored in the storage capacitor 25.

At this time, the voltage $V_{gs}$ between the gate and the source of the drive transistor 22 is amplified depending on the signal voltage $V_{sig}$, but the source potential $V_s$ of the drive transistor 22 is in a floating state as before. Therefore, the charged electric charge of the storage capacitor 25 is discharged depending on the characteristics of the drive transistor 22. Further, at this time, charging of an equivalent capacitor $C_{e1}$ of the organic EL element 21 is initiated by a current that flows to the drive transistor 22.

As a result of the equivalent capacitor $C_{e1}$ of the organic EL element 21 being charged, the source potential $V_s$ of the drive transistor 22 gradually starts to fall as time passes. At this time, variation in the threshold voltage $V_{th}$ of the drive transistor 22 of each pixel has already been cancelled, and a current $I_{ds}$ between the drain and the source of the drive transistor 22 becomes dependent on a movement amount u of the drive transistor 22. Additionally, the movement amount u of the drive transistor 22 is a movement amount of a semiconductor thin film that configures a channel of the corresponding drive transistor 22.

In this case, the amount of the fall (amount of change) in the source potential $V_s$ of the drive transistor 22 acts so as to discharge the charged electric charge of the storage capacitor 25. In other words, the amount of the fall in the source potential $V_s$ of the drive transistor 22 applies negative feedback to the storage capacitor 25.

Therefore, the amount of the fall of the source potential $V_s$ of the drive transistor 22 becomes a feedback amount of the negative feedback. In this manner, by applying negative feedback to the storage capacitor 25 with a feedback amount that depends on the current $I_{ds}$ between the drain and the source that flows to the drive transistor 22, it is possible to negate the dependency of the current $I_{ds}$ between the drain and the source of the drive transistor 22 on the movement amount u. The negation operation (negation process) is a movement amount correction operation (movement amount correction process) that corrects variation in the movement amount u of the drive transistor 22 of each pixel.

More specifically, since the current $I_{ds}$ between the drain and the source becomes larger as a signal amplitude $V_{in}$ ($=V_{sig}-V_{ofs}$) of the image signal that is applied to the gate electrode of the drive transistor 22 increases, an absolute value of the feedback amount of the negative feedback also becomes larger. Therefore, the movement amount correction process is performed depending on the signal amplitude $V_{in}$ of the image signal, that is, the level of light emission brightness. In addition, in a case in which the signal amplitude $V_{in}$ of the image signal is set as a constant, since the absolute value of the feedback amount of the negative feedback also becomes larger as the movement amount u of the drive transistor 22 increases, it is possible to eliminate variation in the movement amount u of each pixel.

At a time $t_6$, the application scanning signal WS attains a non-active state, and signal application and a movement amount correction period end as a result of the sampling transistor 23 attaining a non-conductive state. After the movement amount correction has been performed, at a time $t_7$, the light emission control transistor 24 attains a conductive state due to the light emission control signal DS attaining an active state. As a result of this, a current is supplied from a node of the power supply voltage $V_{dd}$ to the drive transistor 22 through the light emission control transistor 24.

At this time, as a result of the sampling transistor 23 being in a non-conductive state, the gate electrode of the drive transistor 22 is electrically isolated from the signal line 33, and is in a floating state. In this case, when the gate electrode of the drive transistor 22 is in a floating state, the gate potential $V_g$ fluctuates in conjunction with fluctuations in the source potential $V_s$ of the drive transistor 22 due to the storage capacitor 25 being connected between the gate and the source of the drive transistor 22.

That is, the source potential $V_s$ and the gate potential $V_g$ of the drive transistor 22 rise with the voltage $V_{gs}$ between the gate and the source that is stored in the storage capacitor 25 being retained. Further, the source potential $V_s$ of the drive transistor 22 rises to a light emission voltage $V_{oled}$ of the organic EL element 21 that depends on a saturation current of the transistor.

In this manner, an operation in which the gate potential $V_g$ of the drive transistor 22 fluctuates in conjunction with fluctuations in the source potential $V_s$ is a bootstrap operation. In other words, the bootstrap operation is an operation in which the gate potential $V_g$ and the source potential $V_s$ of the drive transistor 22 fluctuate with the voltage $V_{gs}$ between the gate and the source that is stored in the storage capacitor 25, that is, a voltage between both terminals of the storage capacitor 25, being retained.

Further, due to the fact that the current $I_{ds}$ between the drain and the source of the drive transistor 22 begins to flow to the organic EL element 21, the anode potential $V_{ano}$ of the organic EL element 21 rises depending on the corresponding current $I_{ds}$. When the anode potential $V_{ano}$ of the organic EL element 21 eventually exceeds the threshold voltage $V_{the1}$ of the organic EL element 21, the organic EL element 21 begins to emit light since a drive current starts to flow to the organic EL element 21.

Defects in Threshold Correction Preparation Period

In this instance, operation points from the threshold correction preparation period to the threshold correction period (time $t_2$ to time $t_4$) will be focused on. As is evident from the operational explanation that was given above, in order to perform the threshold correction operation, it is necessary to set the voltage $V_{gs}$ between the gate and the source of the drive transistor 22 to a voltage that exceeds the threshold voltage $V_{th}$ of the corresponding drive transistor 22.

Therefore, the current flows to the drive transistor 22, and as shown in the timing waveform diagram of FIG. 3, the anode potential $V_{ano}$ of the organic EL element 21 temporarily exceeds the threshold voltage $V_{the1}$ of the corresponding organic EL element 21 in a portion of time from the threshold correction preparation period to the threshold correction period. As a result of this, a through current of approximately a few mA flows from the drive transistor 22 to the organic EL element 21.

Therefore, in the threshold correction preparation period (which includes a portion in which the threshold correction period is initiated), despite being a non-light-emitting period, the light-emitting unit (organic EL element 21) emit light at a constant brightness in each frame regardless of the gradation of the signal voltage $V_{sig}$. As a result of this, a deterioration in the contrast of the display panel 70 is caused.

DESCRIPTION OF EMBODIMENTS

In order to solve the abovementioned defects, the following configuration is adopted in an embodiment of the present disclosure. That is, at the time of threshold correction (when threshold correction is performed), the first voltage is applied to the source electrode of the drive transistor 22 and a second voltage is applied to the gate electrode thereof, the difference between the first voltage and the second voltage being less than a threshold voltage of the drive transistor. Thereafter, the standard voltage $V_{ofs}$ is applied to the gate electrode in a state in which the source electrode of the drive transistor 22 is in a floating state. This operation is executed on the basis of driving by a drive unit that is formed from the application scanning unit 40, the drive scanning unit 50, the signal output unit 60 and the like In the present embodiment, the power supply voltage $V_{dd}$ is used as the first voltage. However, the first voltage is the second voltage is referred to as the reference voltage $V_{ref}$. In the present embodiment, a voltage that satisfies a relationship of $V_{ref}>V_{dd}-|v_{th}|$ is used as the reference voltage $V_{ref}$.

Figure 4:
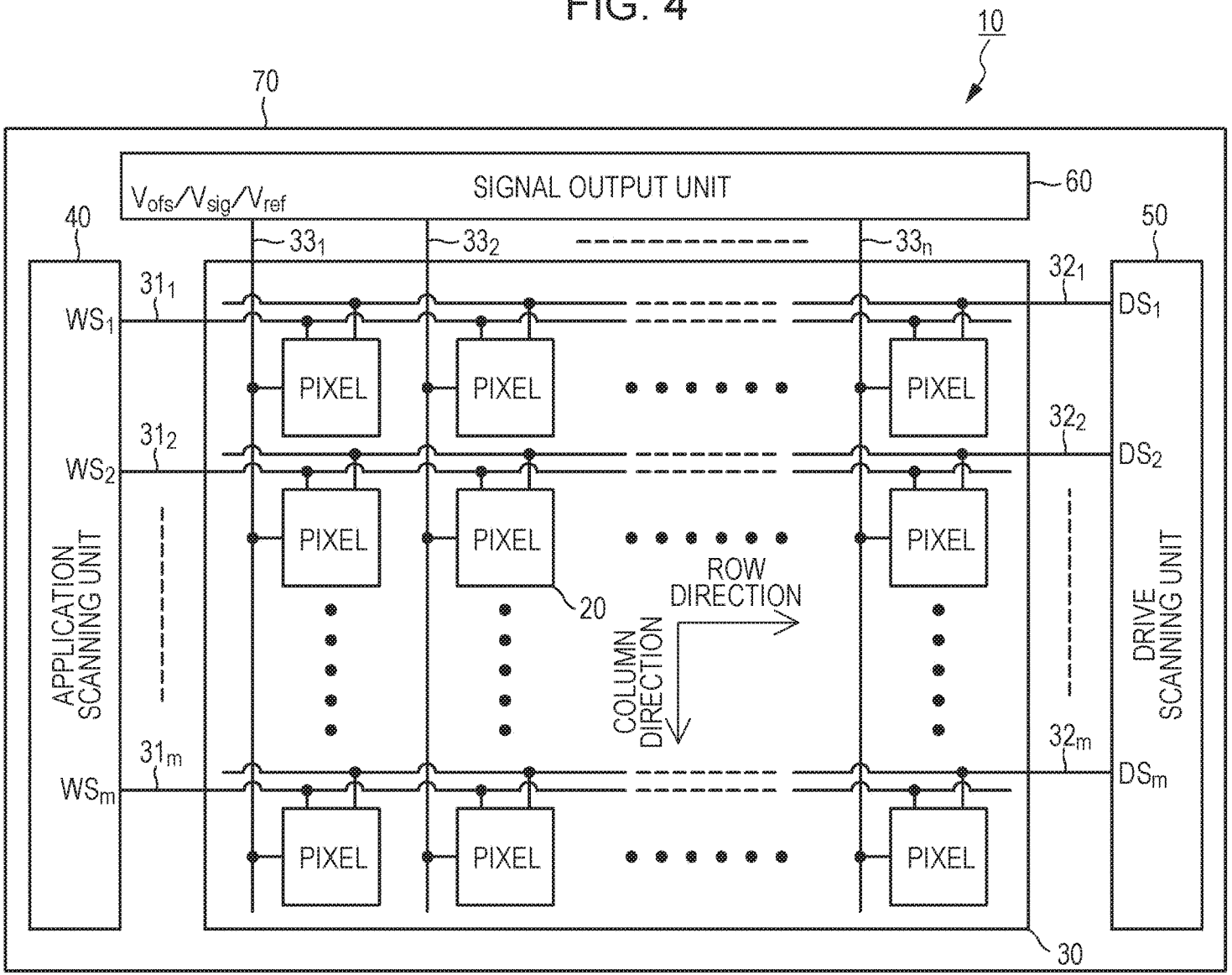
FIG. 4 is a system configuration diagram that illustrates an outline of a configuration of an active matrix type display device according to an embodiment of the present disclosure.

FIG. 4 is a system configuration diagram that illustrates an outline of a configuration of an active matrix type display device as in an embodiment of the present disclosure. In the present embodiment, description will also be given using a case of an active matrix type organic EL display device that uses organic EL elements 21 as the light-emitting units (light emitting elements) of the pixel circuits 20 as an example.

Additionally, the present embodiment includes the driving (driving method) of the pixel circuits (pixels) 20. Therefore, the pixel circuits 20 have the same configuration as the pixel circuits of FIG. 2. That is, a drive circuit that drives the organic EL element 21 has a 3Tr (transistor) circuit configuration that uses a P-channel type drive transistor 22.

In order to realize the abovementioned driving (driving method) in an active matrix type organic EL display device 10 as in the present embodiment, the signal output unit 60 has a configuration that selectively supplies the standard voltage $V_{ofs}$ that is used in threshold correction, the signal voltage $V_{sig}$ of an image signal and the reference voltage $V_{ref}$ to the signal line 33. That is, the potential of the signal line 33 selectively takes the three values of $V_{ofs}/V_{sig}/V_{ref}$.

Figure 5:
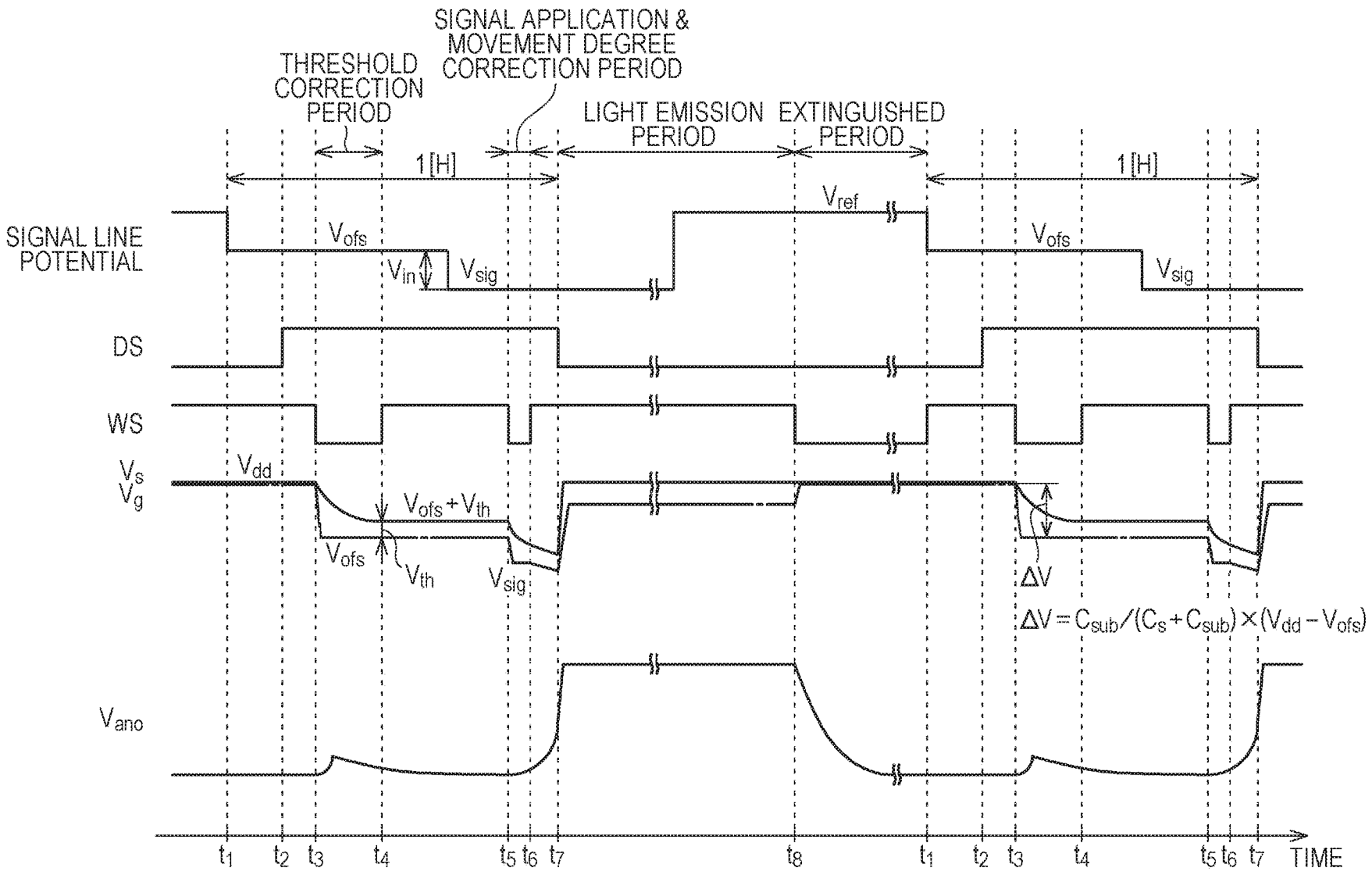
FIG. 5 is a timing waveform diagram for describing the circuit operation of the active matrix type display device according to an embodiment of the present disclosure.

In the following description, the circuit operation of the active matrix type organic EL display device 10 as in the present embodiment will be described using the timing waveform diagram of FIG. 5, and the operation explanatory diagrams of FIGS. 6A to 8B. Additionally, in the operation explanatory diagrams of FIGS. 6A to 8B, in order to simplify the drawings, the sampling transistor 23 and the light emission control transistor 24 are displayed using a switch symbol.

Figure 6A:
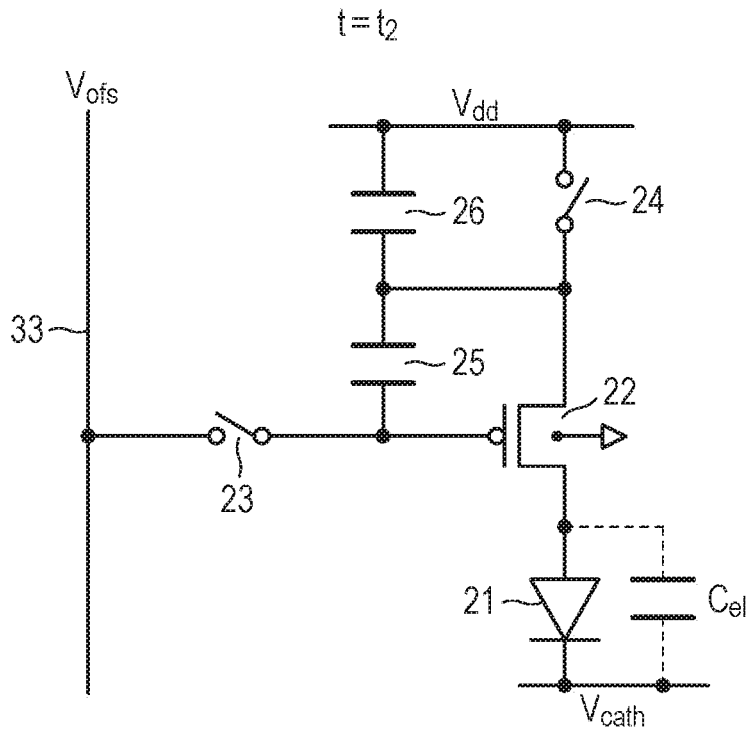
FIG. 6A is an operation explanatory diagram (part 1) that describes a circuit operation.

As shown in FIG. 6A, as a result of the extinguished period ($t_8$ to $t_1$) ending and the light emission control signal DS attaining a non-active state at a time $t_2$, the light emission control transistor 24 attains a non-conductive state. As a result of this, since the electrical connection between the power supply voltage $V_{dd}$ and the source electrode of the drive transistor 22 is cancelled, the source electrode of the drive transistor 22 attains a floating state. At this time, the sampling transistor 23 is also in a non-conductive state.

Figure 6B:
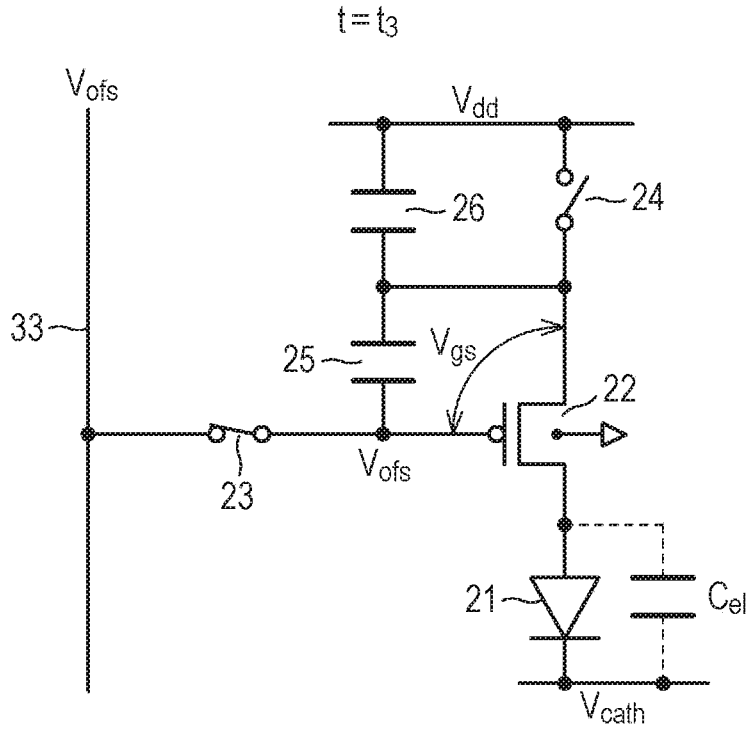
FIG. 6B is an operation explanatory diagram (part 2) that describes a circuit operation.

Next, at a time $t_3$, as shown in FIG. 6B, the sampling transistor 23 attains a conductive state due to the application scanning signal WS attaining an active state, and the potential of the signal line 33 is sampled. At this time, the standard voltage $V_{ofs}$ is in a state of being supplied to the signal line 33. Therefore, by sampling with the sampling transistor 23, the standard voltage $V_{ofs}$ is applied to the gate electrode of the drive transistor 22.

In this instance, since the source electrode of the drive transistor 22 is in a floating state, the source potential $V_s$ of the drive transistor 22 falls with the gate potential $V_g$ due to capacitance coupling that depends on the capacitance ratio of the storage capacitor 25 and the auxiliary capacitor 26. At this time, if the capacitance value of the storage capacitor 25 is set as $C_s$, and the capacitance value of the auxiliary capacitor 26 is set as $C_{subr}$ the source potential $V_s$ of the drive transistor 22 can be given using the following formula (1).

$$V_s=V_{dd}-\{1-C_{sub}/(C_s+C_{sub})\}\times(V_{ofs}-Vdd) \quad (1)$$

Therefore, the voltage $V_{gs}$ between the gate and the source of the drive transistor 22 becomes the following.

$$V_{gs}=\{C_{sub}/(C_s+C_{sub})\}\times(V_{ofs}-V_{dd}) \quad (2)$$

That is, the voltage $V_{gs}$ between the gate and the source of the drive transistor 22 is amplified due to capacitance coupling that depends on the capacitance ratio of the storage capacitor 25 and the auxiliary capacitor 26. The voltage value of the standard voltage $V_{ofs}$ and the capacitance values $C_s$ and $C_{sub}$ of the storage capacitor 25 and the auxiliary capacitor 26 are set to values that satisfy conditions of $V_{gs}>|V_{th}|$. As a result of this, the voltage $V_{gs}$ between the gate and the source of the drive transistor 22 becomes a voltage that exceeds the threshold voltage $V_{th}$.

Figure 7A:
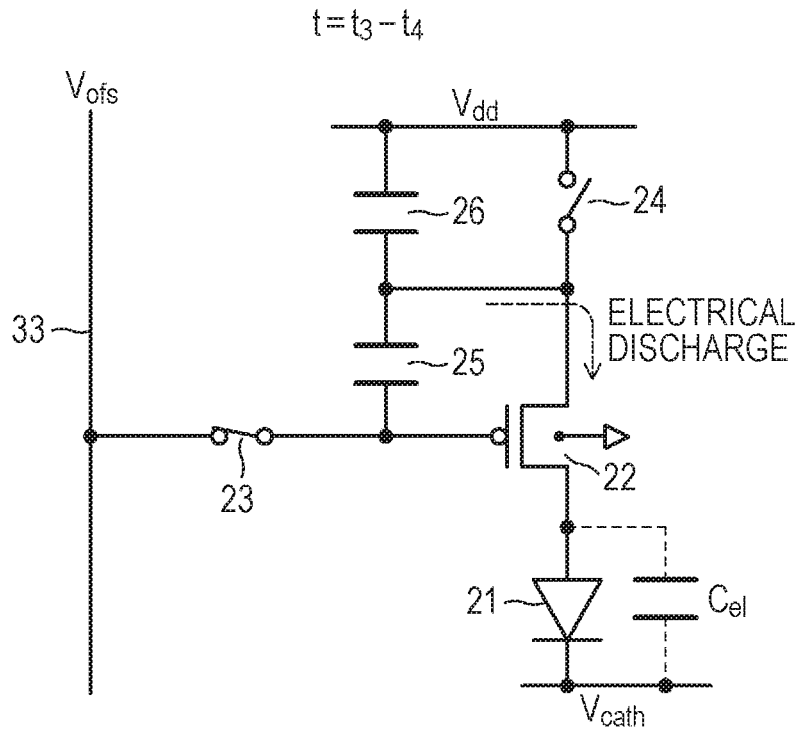
FIG. 7A is an operation explanatory diagram (part 3) that describes a circuit operation.

In the threshold correction period ($t_3$ to $t_4$), as shown in FIG. 7A, an electrical charge that is stored in the storage capacitor 25 is discharged through the drive transistor 22. Further, when the source potential $V_s$ of the drive transistor 22 becomes $V_{ofs}$ the drive transistor 22 attains a non-conductive state, and the threshold correction operation ends. As a result of this, a voltage that corresponds to the $|V_{th}|$ of the drive transistor 22 is stored in the storage capacitor 25.

Figure 7B:
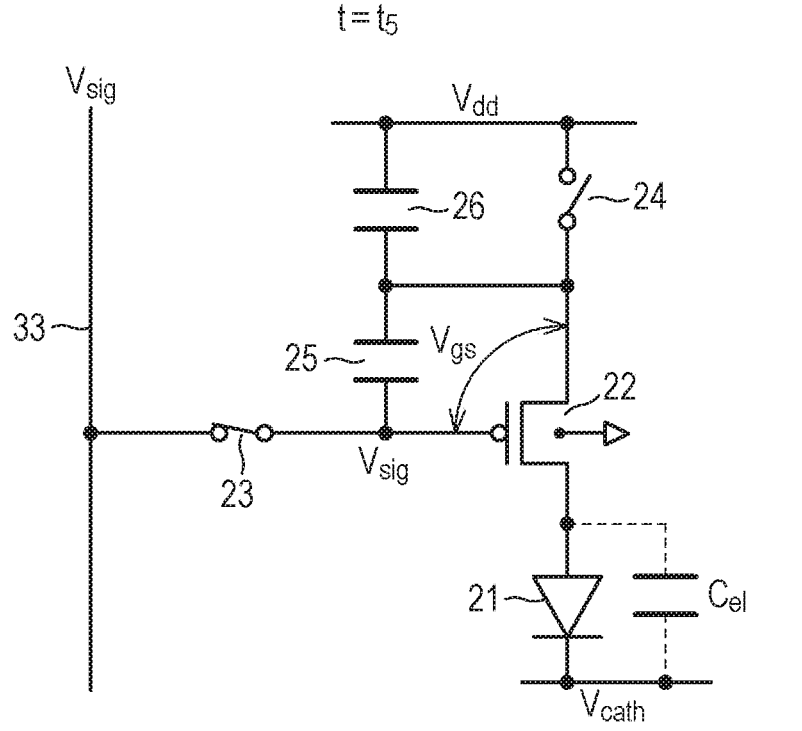
FIG. 7B is an operation explanatory diagram (part 4) that describes a circuit operation.

After the threshold correction period ($t_3$ to $t_4$) ends, the potential of the signal line 33 switches from the standard voltage $V_{ofs}$ to the signal voltage $V_{sig}$ of an image signal. Thereafter, as shown in FIG. 7B, at a time $t_5$, due to the application scanning signal WS attaining an active state, the sampling transistor 23 attains a conductive state again. Further, as a result of the sampling of the sampling transistor 23, the signal voltage $V_{sig}$ is applied to the gate electrode of the drive transistor 22.

At this time, since the source electrode of the drive transistor 22 is in a floating state, the source potential $V_s$ of the drive transistor 22 follows the gate potential $V_g$ due to capacitance coupling that depends on the capacitance ratio of the storage capacitor 25 and the auxiliary capacitor 26. At this time, the voltage $V_{gs}$ between the gate and the source of the drive transistor 22 becomes the following.

$$V_{gs}=\{C_{sub}/(C_s+C_{sub})\}\times(V_{ofs}-V_{sig})+|V_{th}| \quad (3)$$

In this signal application period, since a current flows through the drive transistor 22, movement amount correction is performed while performing application of the signal voltage $V_{sig}$ in the same manner as the case of the operation of the active matrix type organic EL display device 100 that was mentioned above. The operation at the time of movement amount correction is the same as that mentioned above. The signal application and movement amount correction period ($t_5$ to $t_6$) form an extremely short period of a few hundred nanoseconds to a few microseconds.

Figure 8A:
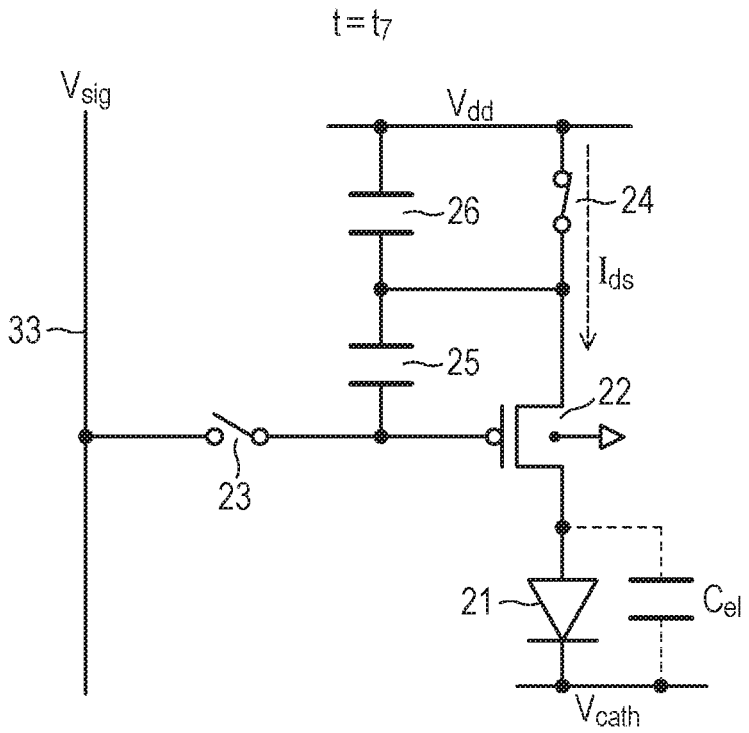
FIG. 8A is an operation explanatory diagram (part 5) that describes a circuit operation.

After the signal application and movement amount correction period ($t_5$ to $t_6$) have ended, at a time $t_7$, as shown in FIG. 8A, the light emission control transistor 24 attains a conductive state due to the light emission control signal DS attaining an active state. As a result of this, the current $I_{ds}$ flows from a node of the power supply voltage $V_{dd}$ to the drive transistor 22 through the light emission control transistor 24. At this time, the bootstrap operation that was mentioned above is performed. Further, when the anode potential $V_{ano}$ of the organic EL element 21 exceeds the threshold voltage $V_{the1}$ of the organic EL element 21, the organic EL element 21 begins to emit light since a drive current starts to flow to the organic EL element 21.

At this time, since there is a state in which correction of the variation of the threshold voltage $V_{th}$ and the movement amount u of the drive transistor 22 in each pixel has been performed, it is possible to obtain image quality with high uniformity that does not have the characteristic variation of the transistor. In addition, in the light emission period, the source potential $V_s$ of the drive transistor 22 rises to the power supply voltage $V_{dd}$, and the gate potential $V_g$ thereof also follows through the storage capacitor 25 and rises in the same manner.

Figure 8B:
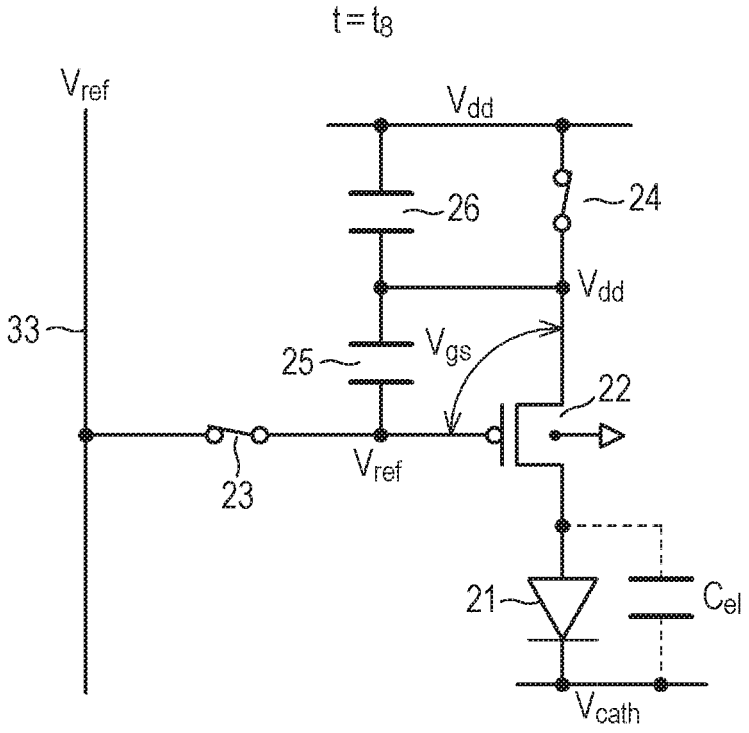
FIG. 8B is an operation explanatory diagram (part 6) that describes a circuit operation.

In a light emission period, the potential of the signal line 33 switches from the signal voltage $V_{sig}$ of an image signal to the reference voltage $V_{ref}$. Further, as shown in FIG. 8B, at a time $t_8$ in which an extinguished period is entered, the sampling transistor 23 attains a conductive state due to the application scanning signal WS attaining an active state. Further, the reference voltage $V_{ref}$ is applied to the gate electrode of the drive transistor 22 by sampling of the sampling transistor 23. At this time, the power supply voltage $V_{dd}$ is applied to the source electrode of the drive transistor 22 since the light emission control transistor 24 is in a conductive state. Therefore, the voltage $V_{gs}$ between the gate and the source of the drive transistor 22 becomes $V_{gs}=V_{dd}-V_{ref}$.

In this instance, by setting the reference voltage $V_{ref}$ to a value that satisfies $V_{dd}-V_{ref}<|V_{th}|$, it is possible to set the drive transistor 22 to a non-conductive state. Further, since the supply of a current to the organic EL element 21 is stopped by the drive transistor 22 attaining a non-conductive state, the organic EL element 21 is extinguished.

In the abovementioned series of circuit operations, each operation of threshold correction, signal application and movement amount correction, light emission and extinguishing is executed in for example, one horizontal period (1H).

Additionally, in this instance, a case in which a driving method that only executes a threshold correction process once was described as an example, but this driving method is merely one example, and the present disclosure is not limited to this driving method. For example, it is possible to adopt a driving method that, in addition to performing threshold correction with movement amount correction and signal application in the 1H period, executes threshold correction a plurality of times by dividing threshold correction over the course of a plurality of horizontal periods that precede the 1H period, that is, performing so-called divided threshold correction.

According to a driving method of the divided threshold correction, even if the time that is allocated as one horizontal period becomes smaller due to the adoption of multiple pixels that accompanies improved definition, it is possible to secure sufficient time over the course of a plurality of horizontal periods as the threshold correction period. Therefore, even if the time that is allocated as 1 horizontal period becomes smaller, since it is possible to secure sufficient time as the threshold correction period, it becomes possible to reliably execute the threshold correction process.

In the manner described above, in comparison with a case of using an N-channel type transistor as the drive transistor 22, it is possible to suppress variation in the transistor in 3Tr pixel circuits that use a P-channel type drive transistor 22. Further, in the 3Tr pixel circuits, by performing a threshold correction operation that uses an extinguishing operation and capacitance coupling, since it is possible to suppress a through current to the organic EL element 21 in the non-light emission period, it is possible to obtain image quality with high uniformity in which the contrast is maintained.

More specifically, by respectively applying the power supply voltage $V_{dd}$ and the reference voltage $V_{ref}$ that satisfies the relationship of $V_{dd}$ $V_{ref}<|V_{th}|$ to the source electrode of the drive transistor 22 and the gate electrode thereof, the voltage $V_{gs}$ between the gate and the source of the drive transistor 22 becomes smaller than the threshold voltage $V_{th}$. At this time, the drive transistor 22 attains a non-conductive state, and since the supply of a current to the organic EL element 21 is not performed, the organic EL element 21 enters an extinguished state (extinguishing operation).

Thereafter, by applying the standard voltage $V_{ofs}$ to the gate electrode of the drive transistor 22, the source electrode of which is in a floating state, the source potential $V_s$ of the drive transistor 22 falls with the gate potential $V_g$ due to capacitance coupling that depends on the capacitance ratio of the storage capacitor 25 and the auxiliary capacitor 26. As a result of this, the voltage $V_{gs}$ between the gate and the source of the drive transistor 22 is amplified to greater than or equal to the threshold voltage $V_{th}$. Therefore, since it is not necessary to provide a threshold correction preparation period in which a through current flows, it is possible to suppress a through current to the organic EL element 21 in a non-light emission period. As a result of this, it is possible to obtain image quality with high uniformity in which the contrast is maintained.

The capacitance values $C_s$ and $C_{sub}$ of the storage capacitor 25 and the auxiliary capacitor 26 can be set arbitrarily provided the values satisfy the abovementioned condition of $V_{gs}>|V_{th}|$. However, by setting to a relationship of $C_s \geq C_{sub}$, since it is possible to reduce the voltage $V_{gs}$ between the gate and the source of the drive transistor 22, it is possible to reduce a current that flows to the drive transistor 22.

In addition, in the pixel circuit as in the present embodiment, as an operation point, the maximum possible voltage is ($V_{dd}-V_{sig}$), and this is for example, a voltage of approximately 4 [V], which is extremely small (low) for a pixel circuit. As a result of this, since it is possible to obtain a margin with respect to the voltage resistance of a transistor that configures a pixel circuit and the voltage resistance that is desired in a capacitor element, it is possible to easily perform thinning of insulating films and use of a high-permittivity material in the storage capacitor 25 and the auxiliary capacitor 26. It is possible to include a silicon nitride film (SiN), titanium oxide (TaO), hafnium oxide (HfO) and the like as examples of high-permittivity materials that configure the storage capacitor 25 and the auxiliary capacitor 26.

MODIFICATION EXAMPLES

The technology of the present disclosure is not limited to the abovementioned embodiment, and various modifications and alterations are possible within a range that does not depart from the scope of the present disclosure. For example, in the abovementioned embodiment, a case in which a display device that is formed by forming a P-channel type transistor that configures the pixels 20 on a semiconductor such as silicon is used, is described as an example, but it is also possible to use the technology of the present disclosure in a display device that is formed by forming a P-channel type transistor that configures the pixels 20 on an insulating body such as a glass substrate.

In addition, in the abovementioned embodiment, the standard voltage $V_{ofs}$ and the reference voltage $V_{ret}$ were selectively applied to the pixel circuits 20 by sampling from the signal line 33 by the sampling transistor 23, but the present disclosure is not limited to this. That is, it is also possible to adopt a configuration in which a dedicated transistor, which independently applies in the standard voltage $V_{ofs}$ and the reference voltage $V_{ret}$, is provided in the pixel circuits 20.

Modification Example 1

In the abovementioned embodiments, the reference voltage $V_{ret}$ was set to use a voltage that satisfies the relationship of $V_{ret}>V_{dd}-V_{th}$, but provided the reference voltage $V_{ret}$ satisfies the abovementioned condition, the reference voltage $V_{ret}$ may be a voltage that differs from the power supply voltage $V_{dd}$ of the pixel circuit 20. However, it is preferable that the reference voltage $V_{ret}$ be the same as the power supply voltage $V_{dd}$. By setting the reference voltage $V_{ret}$ to be the same voltage as the power supply voltage $V_{dd}$, since it is not necessary to provide a dedicated power supply for creating the reference voltage $V_{ret}$, there is a merit in that it is possible to achieve simplification of the system configuration.

Modification Example 2

In the abovementioned embodiment, a configuration of directly switching from the signal voltage $V_{sig}$ of an image signal to the reference voltage $V_{ret}$ when the reference voltage $V_{ret}$ is applied to the signal line 33, is used, but it is possible to adopt a configuration in which an intermediate voltage $V_{mid}$ between the signal voltage $V_{sig}$ and the reference voltage $V_{ret}$ is applied prior to the application of the reference voltage $V_{ref}$.

Figure 9:
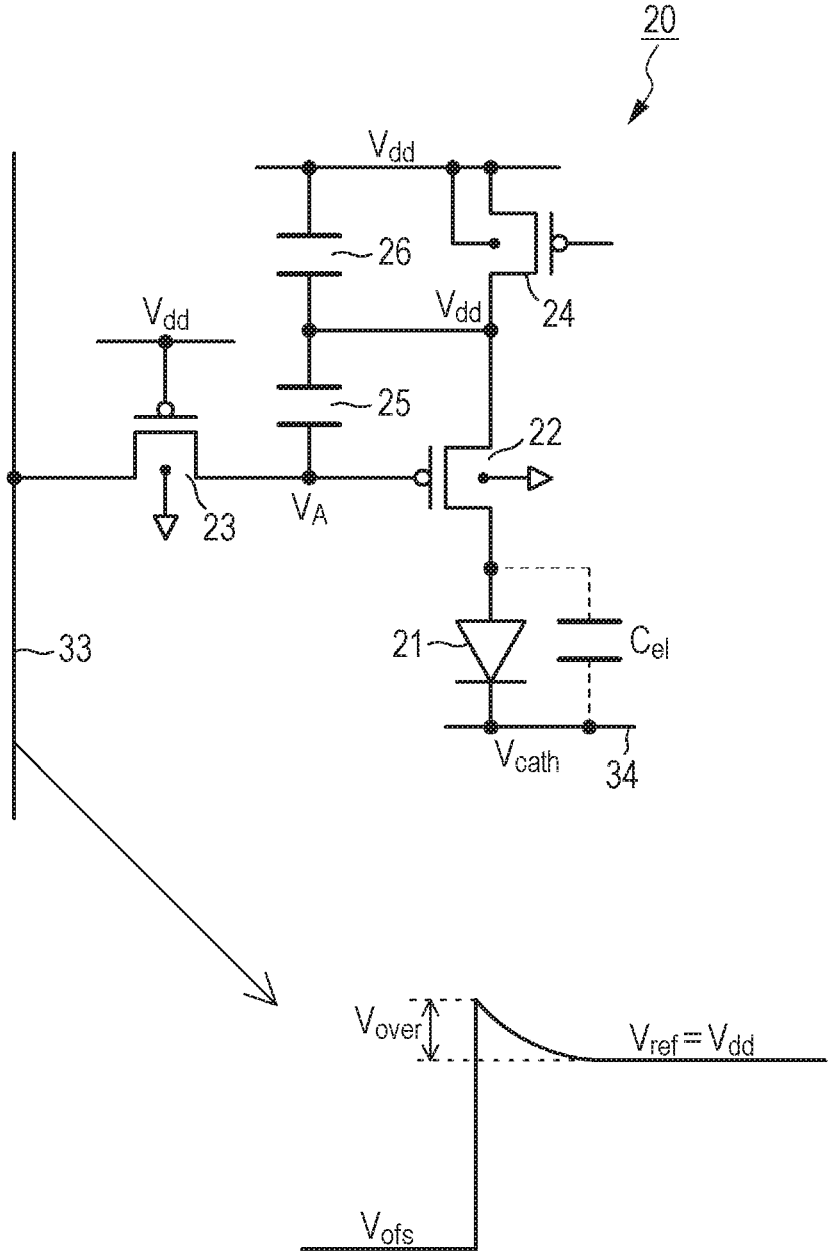
FIG. 9 is an explanatory diagram of the defects of a case of directly switching to a reference voltage $V_{ref}$ from a signal voltage $V_{sig}$ of an image signal.

In a case of directly switching to the reference voltage $V_{ret}$ from the signal voltage $V_{sig}$, as shown in FIG. 9, since the potential of the signal line 33 transitions greatly from $V_{sig}$ to $V_{ret}$, there are cases in which overshoot is generated in the potential of the signal line 33. If overshoot is generated during transition, the potential relationship between the gate potential $V_g$, a drain potential $V_d$, and the source potential $V_s$ (also the potential of the signal line 33) of the sampling transistor 23, which is in a non-conductive state during light emission of the organic EL element 21, collapses.

More specifically, if the gate potential of the drive transistor 22 during light emission is set to $V_A$ and an overshoot potential is set to $V_{over}$, a potential relationship of the sampling transistor 23 becomes $V_g=V_{dd}$, $V_d=V_A$ and $V_s=V_{dd}+V_{over}$. Further, when the relationship becomes $V_{gs}=V_{over}>|V_{th}|$, the sampling transistor 23 momentarily attains a conductive state. Considering this, since the reference voltage $V_{ref}$ is applied to the gate electrode of the drive transistor 22 regardless of whether or not it is during light emission, the brightness deteriorates, and there is a concern that the organic EL element 21 will become extinguished.

Figure 10:
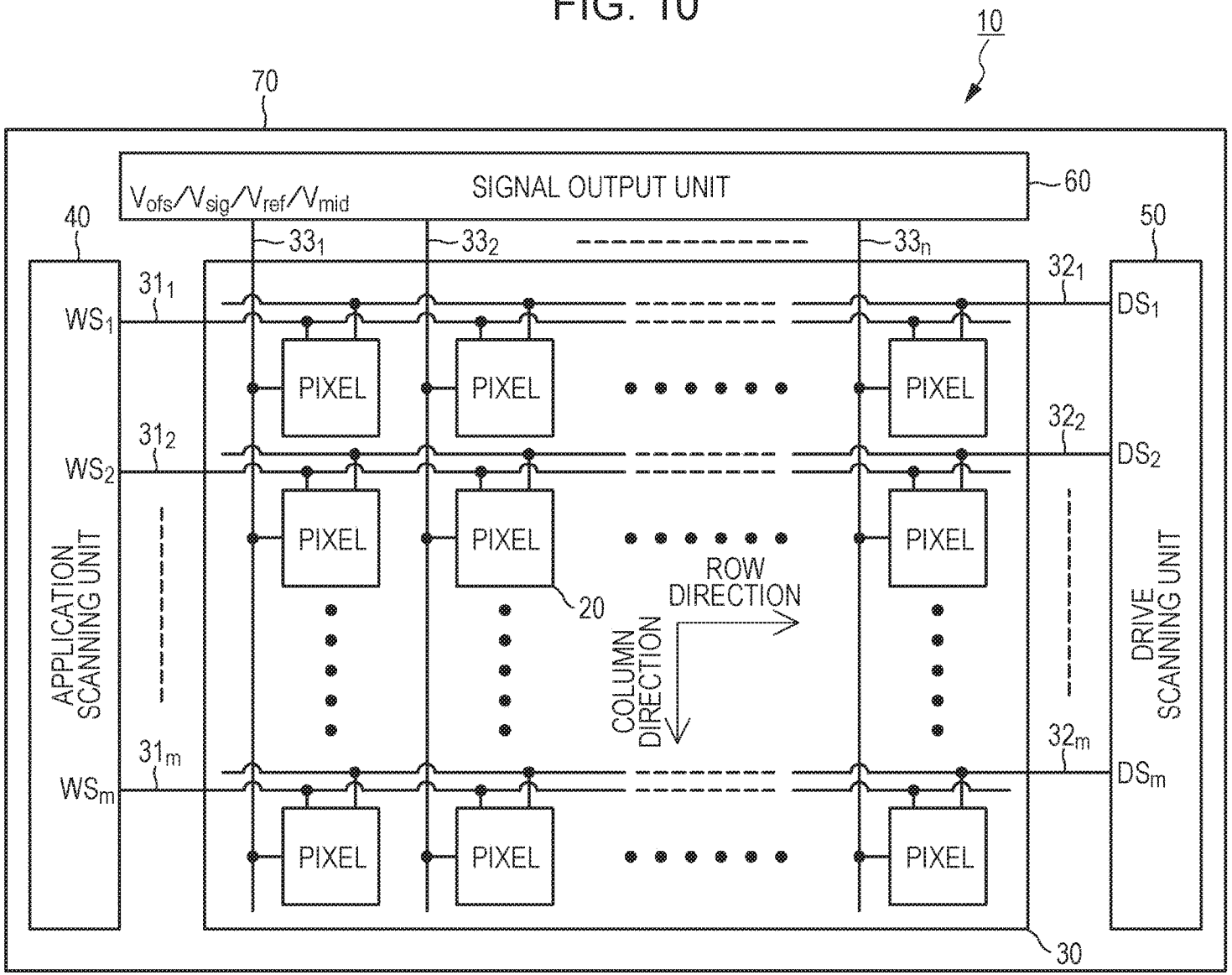
FIG. 10 is a system configuration diagram that illustrates an outline of a configuration of an active matrix type display device according to a modification example of an embodiment of the present disclosure.

Modification Example 2 was devised in order to solve this defect. More specifically, as shown in the system configuration diagram of FIG. 10, the signal output unit 60 has a configuration of selectively supplying the standard voltage $V_{ofs}$ that is used in threshold correction, the signal voltage $V_{sig}$ of an image signal, the reference voltage $V_{ref}$ and the intermediate voltage $V_{mid}$ between the signal voltage $V_{sig}$ and the reference voltage $V_{ref}$ to the signal line 33. That is, the potential of the signal line 33 takes the four values of $V_{ofs}/V_{sig}/V_{ref}/V_{mid}$.

Figure 11:
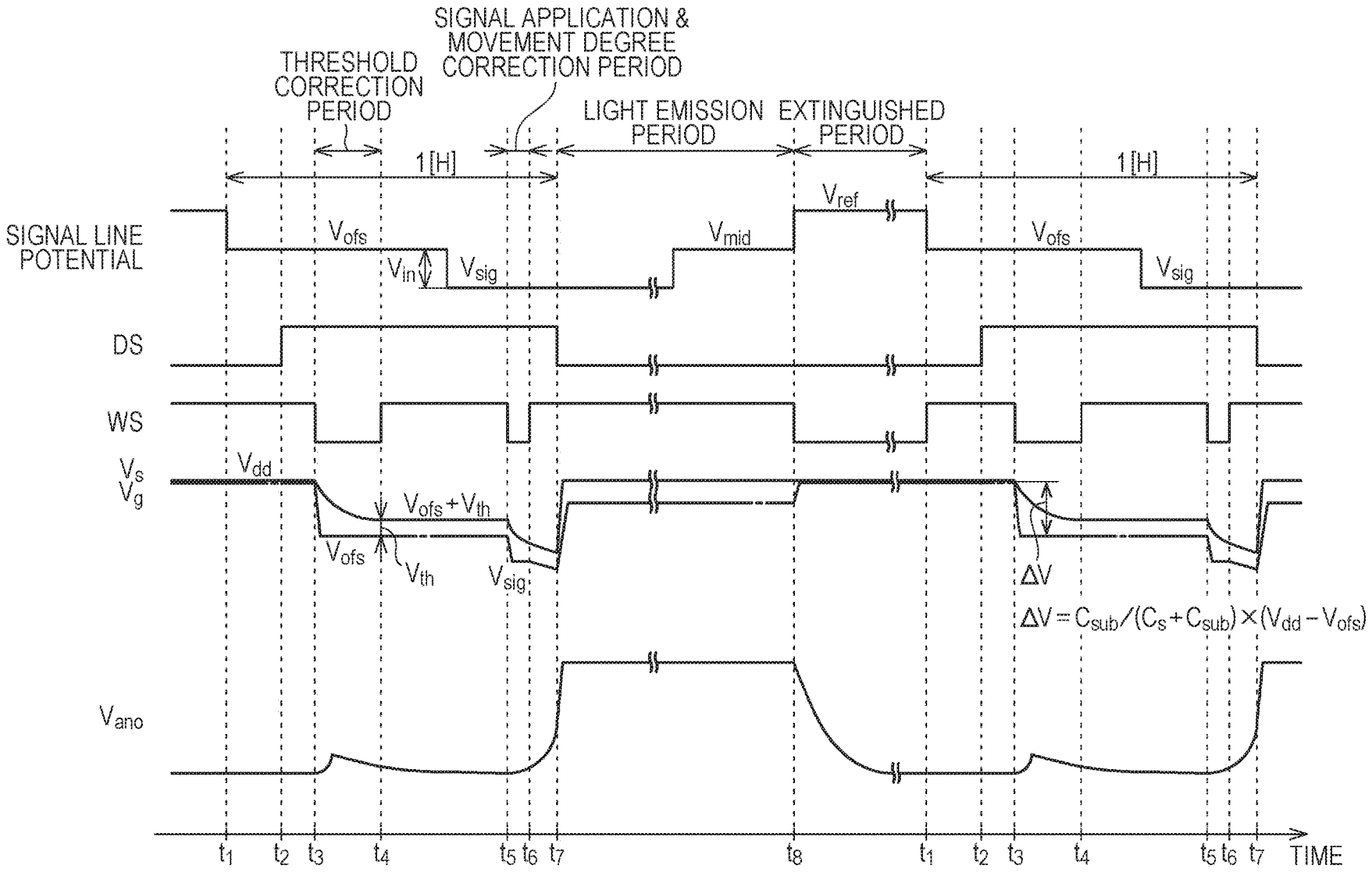
FIG. 11 is a timing waveform diagram for describing the circuit operation of the active matrix type display device according to a modification example of an embodiment of the present disclosure.

Further, as shown in the timing waveform diagram of FIG. 11, when switching from the signal voltage $V_{sig}$ of an image signal to the reference voltage $V_{ref}$, by performing the switch via the intermediate voltage $V_{mid}$ in an order of $V_{sig}\rightarrow V_{mid}\rightarrow V_{ref}$, it is possible to suppress the generation of overshoot. According to this configuration, it is possible to eliminate deteriorations in brightness that are a defect of the extinguishing operation that uses the sampling transistor 23.

In addition, when adopting Modification Example 2, by using the standard voltage $V_{ofs}$ as the intermediate voltage $V_{mid}$, since it is not necessary to provide a dedicated power supply for creating the intermediate voltage $V_{mid}$, it is possible to achieve simplification of the system configuration.

Electronic Apparatus

The display device of the present disclosure that is described above can be used as a display unit (display device) in any field of electronic apparatus that displays image signals that are input to the electronic apparatus or image signals that are generated inside the electronic apparatus as pictures or images.

As is evident from the abovementioned description of the embodiment, since the display device of the present disclosure can securely control the light-emitting units to a non-light-emitting state in the non-light emission period, it is possible to achieve an improvement in the contrast of the display panel. Therefore, by using the display device of the present disclosure as the display unit in any field of electronic apparatus, it becomes possible to realize an improvement in the contrast of the display unit.

In addition to television systems, for example, it is possible to include head-mounted displays, digital cameras, video cameras, game consoles, notebook personal computers and the like as examples of electronic apparatuses, in which the display device of the present disclosure can be used as the display unit. In addition, it is also possible to use the display device of the present disclosure as the display unit in electronic apparatuses such as portable information devices such as e-readers and electronic wristwatches, and mobile communication units such as cellular phones and PDAs.

Additionally, it is possible for the present disclosure to have the following configurations.

<1> A display device that includes a pixel array unit that is formed by disposing pixel circuits that include a P-channel type drive transistor that drives a light-emitting unit, a sampling transistor that applies a signal voltage, a light emission control transistor that controls light emission and non-light emission of the light-emitting unit, a storage capacitor that is connected between a gate electrode and a source electrode of the drive transistor and an auxiliary capacitor that is connected to the source electrode of the drive transistor, and a drive unit that, during threshold correction, respectively applies a first voltage and a second voltage to the source electrode of the drive transistor and the gate electrode thereof, the difference between the first voltage and the second voltage being less than a threshold voltage of the drive transistor, and subsequently performs driving that applies a standard voltage that is used in threshold correction to the gate electrode in a state in which the source electrode of the drive transistor has been set to a floating state.

<2> The display device according to <1>, in which the first voltage is a power supply voltage of pixels.

<3> The display device according to <2>, in which the light emission control transistor is connected between a node of the power supply voltage and the source electrode of the drive transistor, and the drive unit applies the power supply voltage to the source electrode of the drive transistor by setting the light emission control transistor to a conductive state, and sets the source electrode of the drive transistor to a floating state by setting the light emission control transistor to a non-conductive state.

<4> The display device according to any one of <1> to <3>, in which the second voltage is the same as the power supply voltage of the pixels.

<5> The display device according to any one of <1> to <3>, in which the second voltage is a voltage that is different from the power supply voltage of pixels.

<6> The display device according to any one of <1> to <5>, in which the sampling transistor is connected between a signal line and the gate electrode of the drive transistor, and the drive unit applies the second voltage that is applied through the signal line through sampling of the sampling transistor.

<7> The display device according to any one of <1> to <5>, in which the sampling transistor is connected between a signal line and the gate electrode of the drive transistor, and the drive unit applies a standard voltage that is applied through the signal line through sampling of the sampling transistor.

<8> The display device according to any one of <1> to <7>, in which the drive unit raises the source potential of the drive transistor through capacitance coupling of the storage capacitor and the auxiliary capacitor when the standard voltage is applied.

<9> The display device according to any one of <1> to <7>, in which the drive unit amplifies the voltage between the gate and the source of the drive transistor through capacitance coupling of the storage capacitor and the auxiliary capacitor when the standard voltage is applied.

<10> The display device according to any one of <1> to <9>, in which a capacitance value of the storage capacitor is greater than or equal to a capacitance value of the auxiliary capacitor.

<11> The display device according to any one of <1> to <10>, in which, as an operation point of the pixel circuit, the maximum possible voltage is (power supply voltage−signal voltage).

<12> The display device according to <11>, in which the storage capacitor is formed from a high-permittivity material.

<13> The display device according to <11>, in which the auxiliary capacitor is formed from a high-permittivity material.

<14> The display device according to any one of <1> to <13>, in which the second voltage is a voltage that is applied to the signal line, and is sampled by the sampling transistor, and an intermediate voltage between the second voltage and the signal voltage is applied prior to the application of the second voltage to the signal line.

<15> The display device according to <14>, in which the intermediate voltage is the standard voltage.

<16> The display device according to any one of <1> to <15>, in which the light-emitting unit is configured from a current drive type electro-optical element in which light emission brightness changes depending on a current value that flows in a device.

<17> The display device according to <16>, in which the current drive type electro-optical element is an organic electroluminescence element.

<18> The display device according to any one of <1> to <17>, in which the sampling transistor and the light emission control transistor are formed from P-channel type transistors.

<19> A driving method for a display device, in which, when a display device that is formed by disposing pixel circuits, which include a P-channel type drive transistor that drives a light-emitting unit, a sampling transistor that applies a signal voltage, a light emission control transistor that controls light emission and non-light emission of the light-emitting unit, a storage capacitor that is connected between a gate electrode and a source electrode of the drive transistor and an auxiliary capacitor that is connected to the source electrode of the drive transistor, is driven, during threshold correction, a first voltage and a second voltage are applied to the source electrode of the drive transistor and the gate electrode thereof, the difference between the first voltage and the second voltage being less than a threshold voltage of the drive transistor, the source electrode of the drive transistor is set to a floating state thereafter, and subsequently a standard voltage that is used in threshold correction is applied to the gate electrode of the drive transistor.

<20> An electronic apparatus that includes a display device that includes a pixel array unit that is formed by disposing pixel circuits that include a P-channel type drive transistor that drives a light-emitting unit, a sampling transistor that applies a signal voltage, a light emission control transistor that controls light emission and non-light emission of the light-emitting unit, a storage capacitor that is connected between a gate electrode and a source electrode of the drive transistor and an auxiliary capacitor that is connected to the source electrode of the drive transistor, and a drive unit that, during threshold correction, respectively applies a first voltage and a second voltage to the source electrode of the drive transistor and the gate electrode thereof, the difference between the first voltage and the second voltage being less than a threshold voltage of the drive transistor, and subsequently performs driving that applies a standard voltage that is used in threshold correction to the gate electrode in a state in which the source electrode of the drive transistor has been set to a floating state.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a pixel array unit in which pixels are arranged in a matrix pattern; and a driving circuit for driving the pixel array unit, wherein respective ones of the pixels include:

a light emitting element including an anode electrode and a cathode electrode, the cathode electrode being connected to a first voltage line, a first capacitor, a sampling transistor configured to supply a data signal from a data signal line to the first capacitor according to a first control signal supplied from the driving circuit through a first control signal line, a driving transistor configured to supply a driving current from a second voltage line to the light emitting element according to a voltage stored in the first capacitor, and a light emission control transistor connected in series with the driving transistor and the light emitting element between the first and second voltage lines, and configured to turn on and off according to a second control signal supplied from the driving circuit through a second control signal line, and wherein back gates of the sampling transistor and the light emission control transistor are directly connected to the second voltage line.

2. The display device according to claim 1, further comprising a second capacitor connected between the first capacitor and the second voltage line.

3. The display device according to claim 2, wherein the driving circuit is configured to increase a source potential of the driving transistor through capacitance coupling of the first capacitor and the second capacitor when a standard voltage that is used in a correction to a gate of the driving transistor is applied.

4. The display device according to claim 2, wherein the driving circuit is configured to amplify a voltage between the gate and a source of the driving transistor through capacitance coupling of the first capacitor and the second capacitor when a standard voltage that is used in a correction to a gate of the driving transistor is applied.

5. The display device according to claim 1, wherein the sampling transistor is connected between the data signal line and a gate of the driving transistor, and the driving circuit is configured to apply a standard voltage that is used in a correction to the gate of the driving transistor to the sampling transistor through the data signal line.

6. The display device according to claim 1, wherein, as an operation point of the pixel circuit, a maximum possible voltage is equal to a power supply voltage minus a signal voltage.

7. The display device according to claim 1, wherein a back gate of the driving transistor is directly connected to the second voltage line.

8. The display device according to claim 7, wherein the driving transistor is a first P-channel type transistor.

9. The display device according to claim 8, wherein the sampling transistor is a second P-channel type transistor; and wherein the light emission control transistor is a third P-channel type transistor.

10. An electronic apparatus comprising:

a display device comprising:

a pixel array unit in which pixels are arranged in a matrix pattern, and a driving circuit for driving the pixel array unit, wherein respective ones of the pixels include:

a light emitting element including an anode electrode and a cathode electrode, the cathode electrode being connected to a first voltage line, a first capacitor, a sampling transistor configured to supply a data signal from a data signal line to the first capacitor according to a first control signal supplied from the driving circuit through a first control signal line, a driving transistor configured to supply a driving current from a second voltage line to the light emitting element according to a voltage stored in the first capacitor, and a light emission control transistor connected in series with the driving transistor and the light emitting element between the first and second voltage lines, and configured to turn on and off according to a second control signal supplied from the driving circuit through a second control signal line, and wherein back gates of the sampling transistor and the light emission control transistor are directly connected to the second voltage line.

11. The electronic apparatus according to claim 10, further comprising a second capacitor connected between the first capacitor and the second voltage line.

12. The electronic apparatus according to claim 11, wherein the driving circuit is configured to increase a source potential of the driving transistor through capacitance coupling of the first capacitor and the second capacitor when a standard voltage that is used in a correction to a gate of the driving transistor is applied.

13. The electronic apparatus according to claim 11, wherein the driving circuit is configured to amplify a voltage between the gate and a source of the driving transistor through capacitance coupling of the first capacitor and the second capacitor when a standard voltage that is used in a correction to a gate of the driving transistor is applied.

14. The electronic apparatus according to claim 10, wherein the sampling transistor is connected between the data signal line and a gate of the driving transistor, and the driving circuit is configured to apply a standard voltage that is used in a correction to the gate of the driving transistor to the sampling transistor through the data signal line.

15. The electronic apparatus according to claim 10, wherein, as an operation point of the pixel circuit, a maximum possible voltage is equal to a power supply voltage minus a signal voltage.

16. The electronic apparatus according to claim 10, wherein a back gate of the driving transistor is directly connected to the second voltage line.

17. The electronic apparatus according to claim 16, wherein the driving transistor is a first P-channel type transistor.

18. The electronic apparatus according to claim 17, wherein the sampling transistor is a second P-channel type transistor; and wherein the light emission control transistor is a third P-channel type transistor.

* * * * *